US008439480B2

(12) United States Patent
Kida

(10) Patent No.: US 8,439,480 B2
(45) Date of Patent: May 14, 2013

(54) INK JET RECORDING APPARATUS, AND INK JET RECORDING METHOD

(75) Inventor: Shuji Kida, Saitama (JP)

(73) Assignee: Konica Minolta Holdings, Inc., Tokyo (JP)

( * ) Notice: Subject to any disclaimer, the term of this patent is extended or adjusted under 35 U.S.C. 154(b) by 198 days.

(21) Appl. No.: 12/920,539

(22) PCT Filed: Jan. 28, 2009

(86) PCT No.: PCT/JP2009/051340
§ 371 (c)(1),
(2), (4) Date: Sep. 1, 2010

(87) PCT Pub. No.: WO2009/110263

PCT Pub. Date: Sep. 11, 2009

(65) Prior Publication Data

US 2011/0001779 A1 Jan. 6, 2011

(30) Foreign Application Priority Data

Mar. 5, 2008 (JP) ..... 2008-054682
Jul. 7, 2008 (JP) ..... 2008-176738

(51) Int. Cl.
*B41J 2/155* (2006.01)

(52) U.S. Cl.
USPC ..... 347/42; 347/40; 347/21

(58) Field of Classification Search ..... 347/14, 347/15, 19, 40, 43, 54, 57
See application file for complete search history.

(56) References Cited

U.S. PATENT DOCUMENTS

| | | | | |
|---|---|---|---|---|
| 6,120,141 | A | 9/2000 | Tajika | |
| 7,311,394 | B2 * | 12/2007 | Ishikawa et al. | 347/101 |
| 8,152,261 | B2 * | 4/2012 | Furuichi et al. | 347/5 |
| 2005/0062774 | A1 | 3/2005 | Kusunoki | |

FOREIGN PATENT DOCUMENTS

| | | | |
|---|---|---|---|
| DE | 602004006812 | | 1/2008 |
| EP | 0655337 | A2 | 5/1995 |
| EP | 1518678 | | 3/2005 |
| JP | 3240557 | | 10/1991 |
| JP | 8281929 | | 10/1996 |
| JP | 2001115067 | | 4/2001 |
| JP | 2003138168 | | 5/2003 |
| JP | 2005119291 | | 5/2005 |
| JP | 2006231924 | | 9/2006 |
| JP | 2006335924 | | 12/2006 |

* cited by examiner

*Primary Examiner* — Thinh Nguyen
(74) *Attorney, Agent, or Firm* — Lucas & Mercanti, LLP

(57) ABSTRACT

This aims to provide an inkjet recording apparatus which prevents a beading or a color bleeding in a recording system using a line head, and an inkjet recording method. The inkjet recording apparatus comprises an ink line head equipped with nozzle rows having a plurality of nozzles arranged at a predetermined pitch for discharging inks containing coloring materials, and a fixing liquid line head equipped with nozzle rows having a plurality of nozzles arranged at a predetermined pitch for discharging fixing liquids to enhance the fixtures of the inks to a recording medium. The inkjet recording apparatus performs the records by discharging the inks and the fixing liquids from the individual line heads to the recording medium while moving the recording medium and the individual line heads relatively in predetermined directions. The inkjet recording apparatus is characterized in that the nozzle rows of the ink line head and the fixing liquid line head are arranged such that they are deviated from each other by one half of the predetermined pitch in the nozzle row direction.

11 Claims, 4 Drawing Sheets

INK JET RECORDING APPARATUS, AND INK JET RECORDING METHOD

This is a 371 of PCT/JP2009/015340 filed Jan. 28, 2009 which, in turn, claimed the priorities of Japanese Patent Applications Nos. 2008-054682 filed Mar. 5, 2008 and JP2008-176738 filed Jul. 7, 2008, all three Applications are incorporated by reference herein.

FIELD OF TECHNOLOGY

The present invention relates to an inkjet recording apparatus and an inkjet recording method.

TECHNICAL BACKGROUND

The inkjet recording apparatus is currently achieving rapid development in various fields, because the high-definition image can be recordable by relatively simple apparatus. The inkjet recording method is applied to various fields and the recording medium or the inkjet inks are used just for each purpose.

Heretofore, as a printing technology in which enhance the fixtures of the ink to a recording medium having poor ink absorbance such as a film for OHP, employed is a method for recording by overprinting an ink containing colorant and a fixing liquid, which enhance the fixtures of the ink to a recording medium by mixing and reacting with the ink in liquid state.

For example, proposed is an inkjet recording method in which colorless or light-colored liquid having two or more cationic groups per one molecule is deposited onto a recording medium before ink ejection, in order to increase the fixtures of the ink to a recording medium (Patent Document 1).

Further, proposed is an inkjet recording method which comprises a process of forming an image by depositing an ink composition containing at least a pigment and photo reactive polymer fine particles in an aqueous medium and an aggregation liquid containing coagulant which forms aggregation by contacting with the ink composition (Patent Document 2).

Patent Document 1: Unexamined Japanese Patent Application Publication (hereinafter referred to as JP-A) No. 3-240557

Patent Document 2: JP-A No. 2001-115067

SUMMARY OF THE INVENTION

Problems to be Solved by the Present Invention

Recently, needs for high speed recording tends to increase, and the development of a high speed system which uses line scan type inkjet head (hereinafter, refer to as line head) becomes active. However, when an image is recorded in a one-pass operation by line printing of ink and fixing liquid using line head, it was found that even by using above fixing liquid, due to an overlap of adjacent dots, a reaction rate of an agglomeration reaction or a deposition reaction by the fixing liquid at the overlapped portion cannot catch up with a rate of beading caused by droplet coalescence or bleeding at the adjacent dots, resulting in an uneven density caused by the beading at the image of the same color or so called color bleed, that is a color bleeding caused by mixing ink droplets having different colors in the color image on the recording medium.

An object of the present invention is to solve above problem and to provide an inkjet recording apparatus and an inkjet recording method which prevents a beading or a color bleeding in a recording system using a line head.

Means to Solve the Problems

The above object has been attained by the following constitutions:

1. An inkjet recording apparatus which comprises an ink line head equipped with nozzle rows having a plurality of nozzles arranged at a predetermined pitch for discharging an ink containing a coloring material, and a fixing liquid line head equipped with nozzle rows having a plurality of nozzles arranged at a predetermined pitch for discharging a fixing liquid which enhances the fixtures of the ink to a recording medium, and which performs a record by discharging the ink and the fixing liquid from each line head to a recording medium while moving the recording medium and each line head relatively in a predetermined direction, wherein each of the nozzle rows of the ink line head and the nozzle rows of the fixing liquid line head are arranged so that they are deviated from each other by one half of the predetermined pitch in a nozzle row direction.
2. The inkjet recording apparatus of item 1, comprising two sets of the combination of the ink line head and the fixing liquid line head, wherein the nozzle rows of the two ink line heads and the nozzle rows of the two fixing liquid line heads each are arranged so that they are deviated from each other by one half of the predetermined pitch in the nozzle row direction.
3. The inkjet recording apparatus of item 2, wherein the two ink line heads discharge the ink containing the same coloring material.
4. The inkjet recording apparatus of any one of items 1 to 3, wherein the fixing liquid contains an organic acid.
5. The inkjet recording apparatus of any one of items 1 to 3, wherein the fixing liquid contains a polyallylamine.
6. The inkjet recording apparatus of any one of items 1 to 5, wherein the ink is an actinic energy radiation curable ink.
7. The inkjet recording apparatus of item 6, wherein the actinic energy radiation curable ink is a water-based ultraviolet ray curable ink.
8. The inkjet recording apparatus of any one of items 1 to 5, wherein the ink is a water-based pigment ink.
9. The inkjet recording apparatus of item 8, wherein the water-based pigment ink is a fixing type of water-based pigment ink.
10. The inkjet recording apparatus of any one of items 1 to 9, wherein the recording medium is a non-absorbable recording medium.
11. The inkjet recording apparatus of any one of items 1 to 9, wherein the recording medium is an art paper or a coated paper.
12. An inkjet recording method wherein a recording is performed by discharging an ink containing coloring material from an ink line head equipped with nozzle rows having a plurality of nozzles and by discharging a fixing liquid from a fixing liquid line head equipped with nozzle rows having a plurality of nozzles for discharging fixing liquid which enhances the fixtures of the ink to a recording medium, while moving the recording medium and each line head relatively in a predetermined direction, comprising steps of:

discharging a plurality of recording dots arranged in nozzle row direction from each nozzle of either the ink line head or the fixing liquid line head, while moving in the predetermined direction, followed by discharging a plurality of recording dots between a plurality of the former discharged recording dots from each nozzle of the other line head.

13. The inkjet recording method of item 12, in which there are two sets of the combination of the ink line head and the fixing liquid line head, comprising steps of:

discharging a plurality of recording dots arranged in nozzle row direction from each nozzle of either the ink line head or the fixing liquid line head in the same combination set, while moving in the predetermined direction, followed by discharging a plurality of recording dots arranged in the nozzle row direction from each nozzle of the other line head in the same combination set between a plurality of the former discharged recording dots.

Effects of the Invention

The present invention can provide an inkjet recording apparatus and an inkjet recording method which prevents a beading or a color bleeding in a recording system using a line head.

DESCRIPTION OF THE ALPHANUMERIC DESIGNATIONS

| | |
|---|---|
| 1 | Inkjet recording apparatus |
| 2 | Platen |
| 5 | Ultraviolet ray irradiating device |
| HY, HM, HC, HK | Line head unit |
| N | Nozzle |
| P | Recording medium |

DESCRIPTION OF THE PREFERRED EMBODIMENT

Hereafter, an optimal embodiment to practice the present invention will now be detailed.

<<Inkjet Recording Apparatus>>

Figure 1:
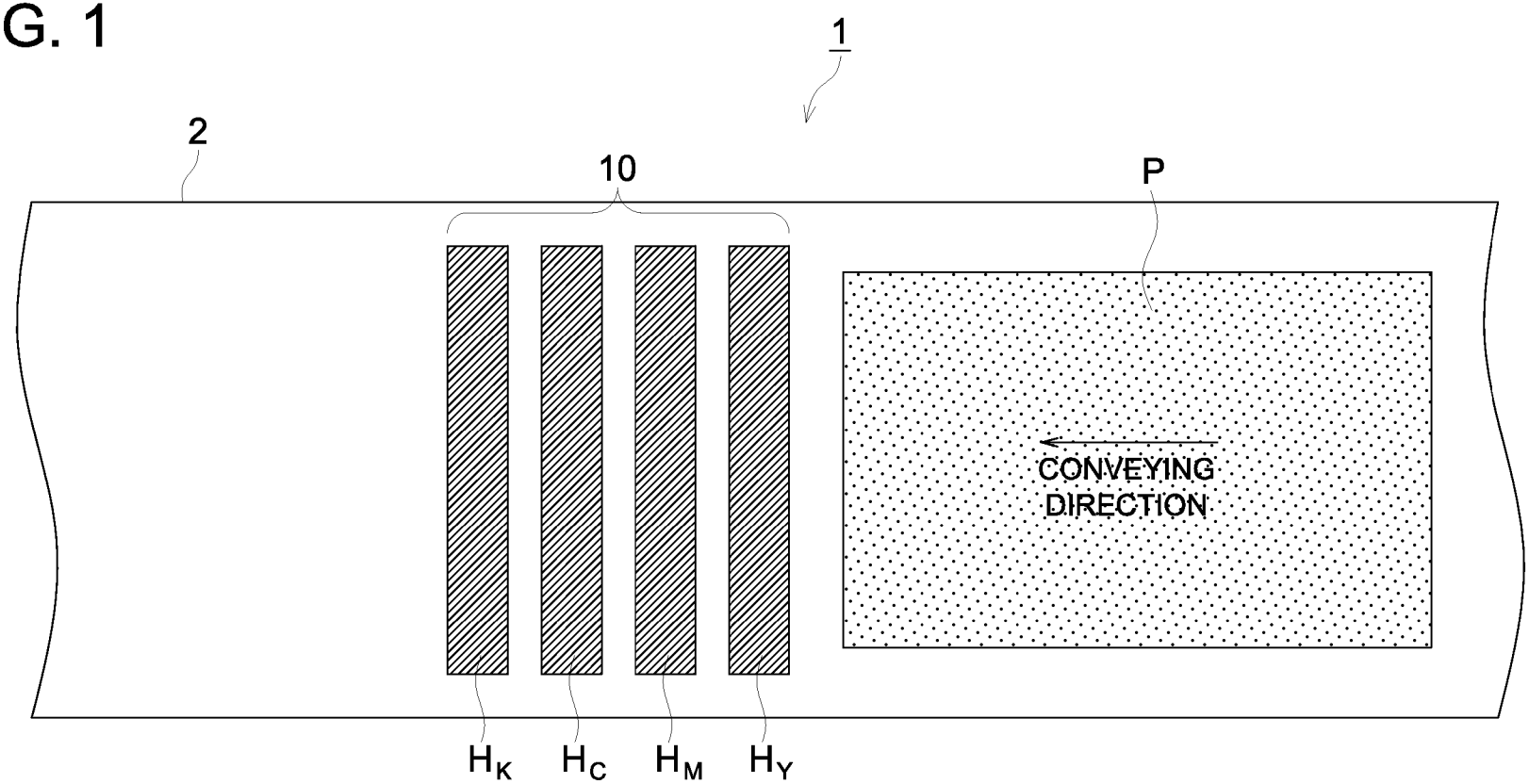
FIG. 1 is an outline top view showing an example of an inkjet recording apparatus comprising a plurality of line head units.

FIG. 1 is an outline top view showing an example of an inkjet recording apparatus related to the embodiment of the present invention.

In FIG. 1, provided on a platen 2 to hold a recording medium P, is an inkjet printer 1 comprising line head units HY, HM, HC, and HK to mount an ink set composed of two or more kinds of ink thereon (FIG. 1 shows an example of an ink set constituted by yellow ink, magenta ink, cyan ink, and black ink). In this regard, as the ink set, an ink set constituted by two or more inks or an ink set constituted by a monochromatic ink may be employed.

Each line head unit comprises a plurality of line heads which extends long in the across-the-width direction of a recording medium P orthogonal to the conveying direction of the recording medium. On a surface of the nozzle opposing to the surface of the recording medium P in parallel, a plurality of nozzles are arranged to extend along in the across-the-width direction of a recording medium P to the corresponding length of the width of a recording medium P.

As the line head, any one of the on demand type and the continuous type may also usable. Further, as jetting methods, electric-machine conversion types (for example, a single cavity type, a double cavity type, a vendor type, a piston type, a share mode type, and a shared wall type etc.); electric-thermal conversion types (for example, a thermal inkjet type, a bubble jet type (registered trademark), etc.); electrostatic suction types (for example, an electric-field-control type, a slit jet type, etc.), an electrically discharging type (for example, a spark jet type etc.), etc. may be listed as a concrete example, and any one of the above types can be employed.

Figure 2A:
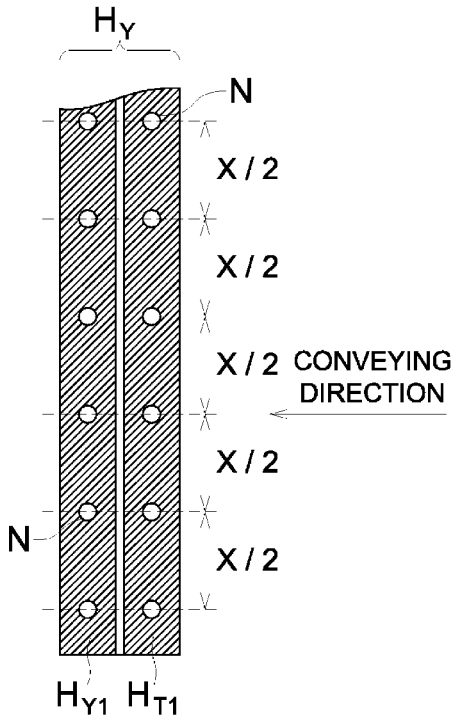
FIG. 2 is a bottom view showing a relation of nozzle positions in line head unit.
Figure 2B:
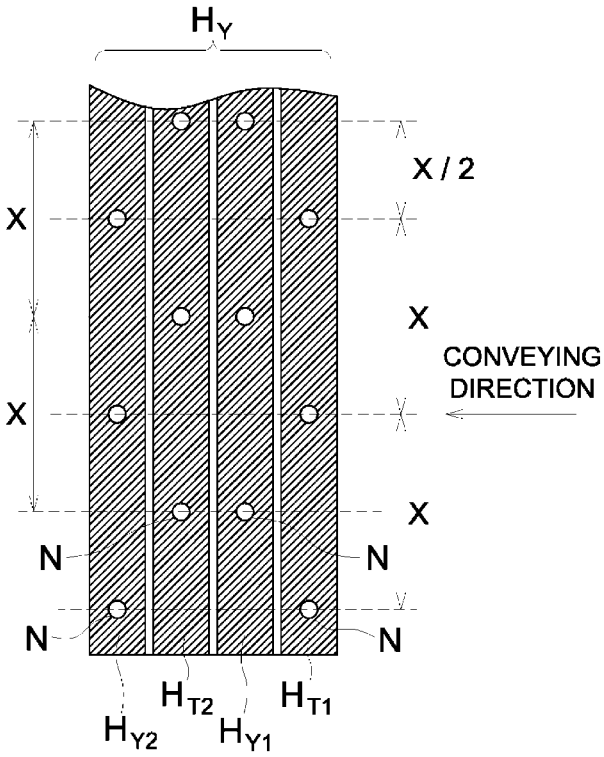

FIG. 2*b* is a bottom view showing a construction of a line head unit. As the construction of a line head unit is common to each color, hereafter explained is about the line head unit HY for ejecting yellow ink as a representative of line head unit.

FIG. 2*b* shows an arrangement of each nozzle N viewed from the bottom side of the line head unit HY, and there are arranged, in order from upstream in the conveyance direction of a recording medium, a fixing liquid line head HT1 in which a nozzle row to discharge fixing liquid to enhance fixtures of ink to a recording medium is arranged, an ink line head HY1 in which a nozzle row to discharge yellow ink is arranged, a fixing liquid line head HT2 in which a nozzle row to discharge fixing liquid to enhance fixtures of ink to a recording medium is arranged, and an ink line head HY2 in which a nozzle row to discharge yellow ink is arranged.

The rows of nozzles of the ink line head HY1 and the fixing liquid line head HT1 are arranged so that they are shifted from each other by one half of a pitch. In a similar way, the rows of nozzles of the ink line head HY2 and the fixing liquid line head HT2 are arranged so that they are shifted from each other by one half of a pitch.

As described above, there are two combinations between the ink line head and the fixing liquid line head, and two ink line heads HY1 and HY2 which discharge ink of the same color and two fixing liquid line heads HT1 and HT2 are arranged so that they are shifted from each other by one half of a pitch. The direction of all rows of nozzles is identical (being parallel), and is set in a perpendicular direction to the conveyance direction of the recording medium.

Each of the nozzles N of HT1 and HY2 is located at the same position in the nozzle row direction, and each of the nozzles N of HY1 and HT2 is located at the same position between the nozzles of HT1 and the nozzles of HY2. Namely, if a nozzle pitch of each line head is denoted by X (mm), then each of nozzles of HT1 and HY2, and each of nozzles of HY1 and HT2 are shifted in the nozzle row direction by one half of a nozzle pitch X (mm), that is, by a half pitch X/2 (mm), so that another one dot is formed between a nozzle and an adjacent nozzle.

In this way, the node pitch X of each line head is set to double the dot pitch X/2 (FIG. 3) in the perpendicular direction to the conveyance direction of the recording medium to be obtained.

The inkjet recording apparatus of the present embodiment is provided with a line head unit shown in FIG. 2*b* for each of colors of Y, M, C and K, and carries out an image recording while repeating steps of discharging ink and fixing liquid onto the recording medium P from each nozzle of the total 16 rows of nozzles of each line head, and subsequently conveying the recording medium P to the prescribed position.

Figure 3:
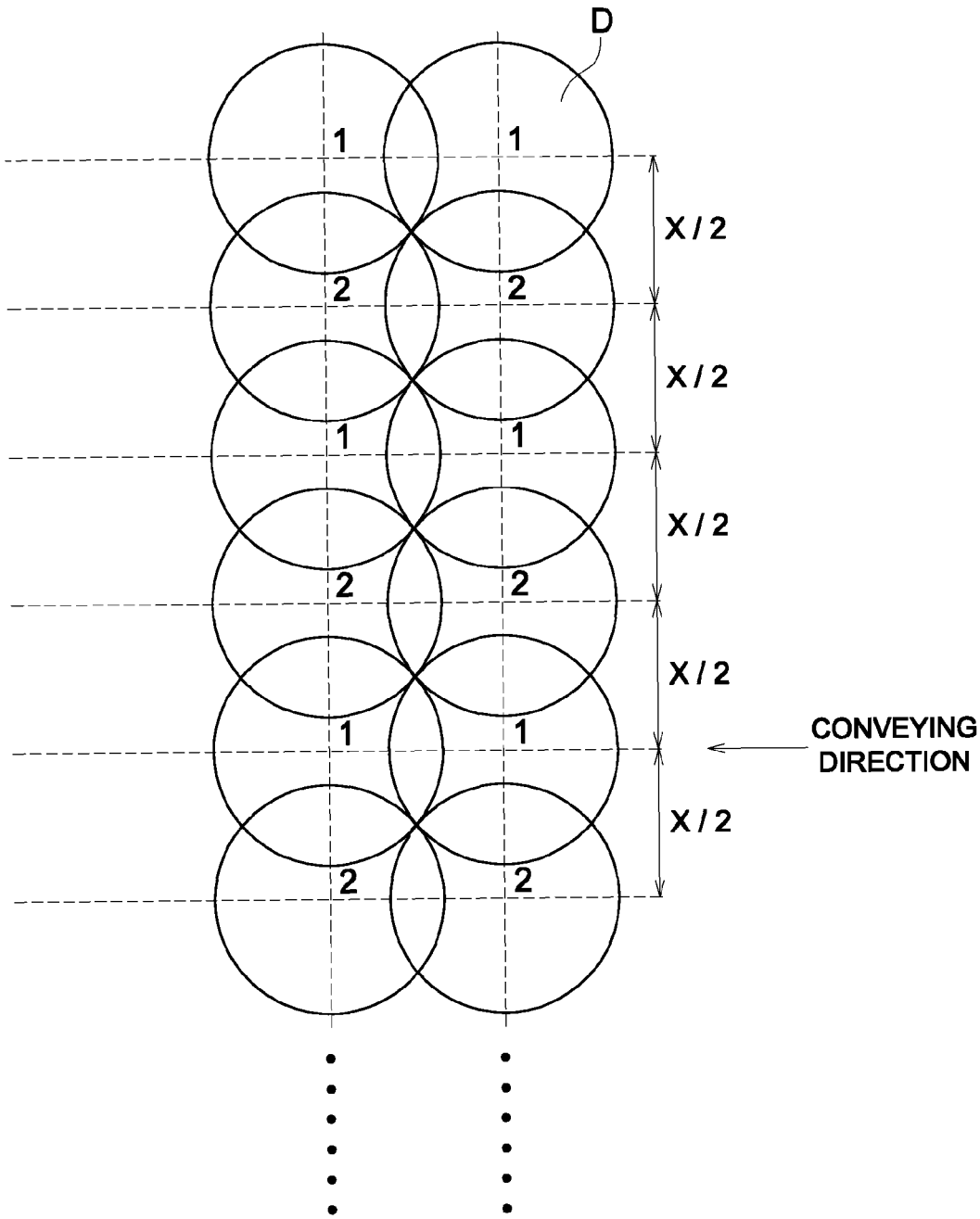
FIG. 3 is a plain view schematically showing dots of an ink and a fixing liquid formed on a recording medium during an image recording.

Next, referring to FIG. 3, there will be described a recording sequence (being a sequence of landing of droplet) of each ink and each fixing liquid using the inkjet recording apparatus 1 composed of the constitution described in FIG. 1. FIG. 3 is a plain view illustrating dots D (being picture elements) of ink and fixing liquid, which are formed on a recording medium. The prescribed image forming region is formed in such a way that a dot line constituted of a repetition of the dot 1 and dot 2 in the direction perpendicular to the conveyance direction of the recording medium (being a direction of a nozzle row) is repeated in the conveyance direction.

First, a recording is carried out by the line head unit HY while conveying the recording medium. When a front end of the image forming region on the recording medium reaches a nozzle position of the line head HT1, each of dots 1 of fixing liquid is deposited on the recording medium by the line head HT1. Subsequently, when a front end of the image forming region on the recording medium reaches a nozzle position of the line head HY1, each of dots 2 of yellow ink is deposited by the line head HY1 on each of positions between dots 1 of fixing liquid which were formed before then. After that, when a front end of the image forming region on the recording medium reaches a nozzle position of the line head HT2, each of dots 2 of fixing liquid is deposited by the line head HT2 on each of positions between dots 1 of fixing liquid (on each of dots 2 of yellow ink) which were formed before then. Subsequently, when a front end of the image forming region on the recording medium reaches a nozzle position of the line head HY2, each of dots 2 of yellow ink is deposited by the line head HY2 on each of positions between dots 2 of yellow ink (on each of dots 1 of fixing liquid) which were formed before then. After completion of the recording by the line head HY2 on the rear end portion of the image forming region, the recording by the line head HY on the prescribed image forming region is completed. In a similar way to the above, the recording is concurrently carried out with the line head units HM, HC, and HK, and as a result, an image is recorded in a one-pass operation with each line head, that is, the prescribed image is recorded only by the recording medium P passing once through each line head.

In this method, the time difference of dot deposit between the dot 1 and the dot 2 can be controlled by a distance between the rows of nozzles of the two line heads HY1 and HY2, which discharge ink of the same color, and a conveyance speed of a recording medium.

For each picture element, it is preferable to fix a ratio (A/B) of discharge amount A of fixing liquid from the above fixing liquid line head in an image section to the total discharge amount B of ink of the plural number of colors from the above plural number of ink line heads. With this, for example, in case where discharge amounts of ink at a non-image portion, at a monochrome portion, at a portion where two colors are superimposed, and at a portion where three colors are superimposed are denoted as 0, I, 2I, and 3I, respectively, it is possible to enhance uniformity of an effect for preventing beading or color bleed, by denoting discharge amounts of fixing liquid at a non-image portion, at a monochrome portion, at a portion where two colors are superimposed, and at a portion where three colors are superimposed as 0, K, 2K, and 3K, respectively, since the discharge amount of fixing liquid is increased for a picture element for which the discharge amount of ink is large compared to a picture element for which the discharge amount of ink is small.

In the above method, there was described a solid color image (100% solid image for Y, M, C, and K, in the above example) in which image degradation due to beading is likely to occur, since a discharge amount of ink is large. However, each of ink dots is not always formed on all picture elements depending on image data, but at least each of ink dots is selectively formed depending on image data.

Attachment of the fixing liquid to the recording medium may be a mode that the fixing liquid is selectively attached depending on the image data, or may be a mode that the fixing liquid is attached to all picture elements regardless of image data, but the former mode is preferable in view of dryness or the amount of consumption of the fixing liquid.

For example, in FIG. 3, in case where each ink dot of the dot 2 is not foamed and each ink dot of only the dot 1 is formed, each dot of fixing liquid of at least the dot 2 may be formed so that the dot of fixing liquid is formed between the ink dots, and therefore, each dot of fixing liquid of the dot 1 may not be formed.

Next, an arrangement of each nozzle N is shown in FIG. 2*a* on an inkjet recording head unit of a comparative example.

In FIG. 2*a*, there are arranged, in order from upstream in the conveyance direction of a recording medium, a fixing liquid line head HT1 in which a nozzle row to discharge fixing liquid to enhance fixures of ink to a recording medium is arranged, and an ink line head HY1 in which a nozzle row to discharge yellow ink is arranged.

Each of nozzles HT1 and HY1 are located at the same position in the direction of a nozzle row. The nozzle pitch of each nozzle row is X/2 (mm), and is set so that the nozzle pitch is equal to the dot pitch X/2 (FIG. 3) in the direction perpendicular to the conveyance direction of the recording medium to be obtained.

The inkjet recording apparatus of the comparative example is provided with a line head unit shown in FIG. 2*a* for each of colors of Y, M, C and K, and carries out an image recording while repeating steps of discharging ink and fixing liquid onto the recording medium P from each nozzle of the total 8 rows of nozzles of each line head, and subsequently conveying the recording medium P to the prescribed position.

In this comparative example, first of all, a recording is carried out by the line head unit HY while conveying the recording medium. When a front end of the image forming region on the recording medium reaches a nozzle position of the line head HT1, each of dots 1 and each of dots 2 of fixing liquid (refer to FIG. 3) are deposited on the recording medium by the line head HT1. Subsequently, when a front end of the image forming region on the recording medium reaches a nozzle position of the line head HY1, each of dots 1 and each of dots 2 of yellow ink are deposited by the line head HY1 on each of dots 1 and each of dots 2 of fixing liquid which were formed before then. After completion of the recording by the line head HY1 on the rear end portion of the image forming region, the recording by the line head HY on the prescribed image forming region is completed. In a similar way to the above, the recording is concurrently carried out with the line head units HM, HC, and HK, and as a result, an image is recorded in a one-pass operation with each line head.

In this method, the dots 1 and 2, which are adjacent with each other, are deposited almost simultaneously on the recording medium. The dot pitch X/2 in the direction perpendicular to the conveyance direction of the recording medium to be obtained becomes equal to the nozzle pitch X/2 of each line head.

As stated above, in FIG. 2*b*, since the rows of nozzles of the ink line head HY1 and the fixing liquid line head HT1 are arranged so that they are shifted from each other by one half of a pitch, it becomes possible to form the fixing liquid dots by the fixing liquid line head HT1 between the ink dots formed by the ink line head HY1. As a result, compared to the constitution of FIG. 2*a*, in which the fixing liquid dot is formed on the ink dot, an effect for preventing beading of adjacent dots in the direction of nozzle row or an effect for preventing color bleed of a color image are enhanced.

Further, in FIG. 2*b*, since there are two combinations between the ink line head and the fixing liquid line head, and two ink line heads HY1 and HY2, which discharge ink of the same color, and two fixing liquid line heads HT1 and HT2 are arranged so that they are shifted from each other by one half of a pitch, it becomes possible to record an image in a one-pass operation in a state that dots are not arranged in succession in the direction of nozzle row at the time of recording by the ink line heads HY1, and thereby, compared to FIG. 2*a*, in which dots are arranged in succession, the distance between dots in the direction of nozzle row is elongated. Further, it becomes possible to set a prescribed time interval before an deposit of an adjacent ink dot having the same color by the ink line head HY2, and thereby, compared to the constitution of FIG. 2*a*, in which the ink dots being adjacent with each other in the direction of nozzle row, are allowed to be deposited almost simultaneously, an effect for preventing beading of adjacent dots in the direction of nozzle row or an effect for preventing color bleed of a color image are further enhanced.

Figure 4:
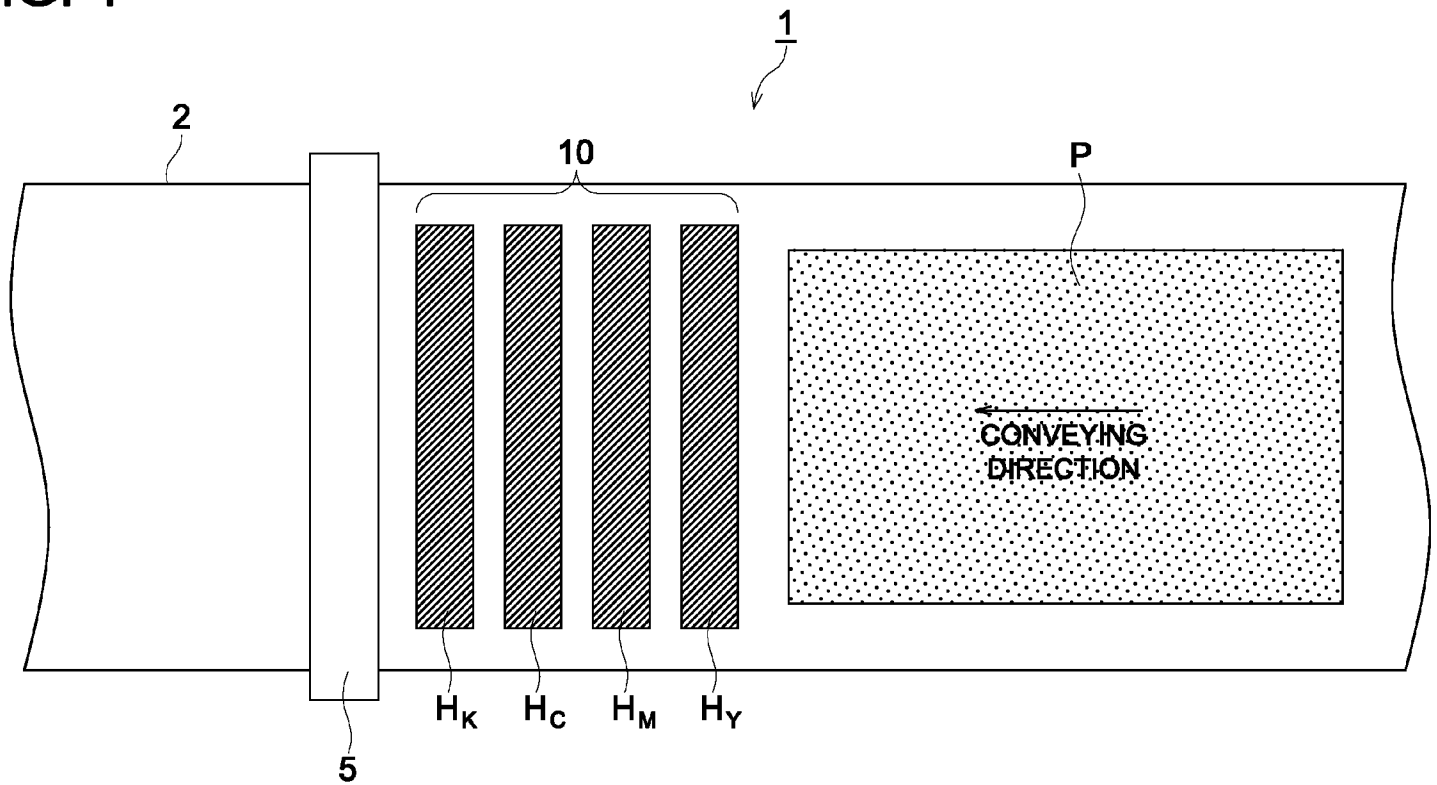
FIG. 4 is an outline top view showing an example of an inkjet recording apparatus in which a plurality of inkjet recording heads and the ultraviolet ray irradiating device are arranged.

Next, shown in FIG. 4 is a preferred embodiment of an inkjet recording apparatus having an ultraviolet irradiation device which irradiates an ultraviolet ray to a printed recording medium. FIG. 4 is similar to FIG. 1 except that an ultraviolet ray irradiating device 5 is arranged. As the ultraviolet ray irradiating device 5, for example, a commonly known conventional light source is used such as low, medium, or high-pressure mercury lamp having an operating pressure of from several hundreds Pa to 1 MPa, a metal halide lamp, a xenon lamp having an emission wavelength in the UV region, a cold-cathode tube, a hot-cathode tube, and an LED.

As an ultraviolet irradiation condition, it is preferable that ultraviolet rays are irradiated within 0.01 to 5.0 seconds after ink and fixing liquid have been deposited on a recording medium. It is particularly important that irradiation timing is as fast as possible to record a high-definition image. The irradiation timing can be achieved by suitably control an interval between the ultraviolet ray irradiating device and line head nozzles and a conveyance speed of a recording medium.

In the present invention, it is more preferable to heat the recording medium during recording or before or after the recording. Heating the recording medium remarkably increases a drying and thickening speed, resulting in a high image quality. In addition, the image durability is also improved. The preferred temperature range of heating is 30° C. or more and 70° C. or less at recording surface temperature of the recording medium. When the recording medium is heated to 30° C. or more, the gloss of the recorded material becomes excellent, and when the temperature is 70° C. or less, the recording medium is not deformed resulting in an excellent conveyance property.

The heating method may be selected from a method in which an exothermic heater is incorporated into a medium conveyance system or a platen member, and then the recording medium is heated by direct contact with the heater from below of the recording medium, or a method in which the recording medium is heated by indirect contact with a heater such as a lamp from below or above of the recording medium.

<<Ink>>

An ink of the present invention will now be described.

Various inkjet inks described below may be usable in the inkjet recording apparatus and the inkjet recording method of the present invention.

[Actinic Energy Radiation Curable Ink]

(Non-Aqueous Type Actinic Energy Radiation Curable Ink)

As an example of the ink of the present invention, listed is non-aqueous type actinic energy radiation curable ink comprising an actinic energy radiation polymerizable compound as well as the colorant.

The non-aqueous type actinic energy radiation curable ink related to the present invention mainly comprises an actinic energy radiation polymerizable compound (hereinafter, simply refer to as polymerizable compound), a photo polymerization initiator and a colorant; and mainly cured by using an ultraviolet ray as an actinic energy radiation. In the present invention, it is abbreviated to as UV ink.

As an actinic energy radiation polymerizable compound applicable to the actinic energy radiation curable ink, a radical polymerizable compound and a cationic polymerizable compound can be listed. According to the present invention, a cationic polymerizable compound is preferably employed.

According to the present invention, as the cationic polymerizable compound, various well-known cationic polymerizable monomers can be used. Among them, listed are a compound containing oxirane group, epoxy compound disclosed in, for example, JP-A Nos. 6-9714, 2001-31892, 2001-40068, 2001-55507, 2001-310938, 2001-310937 and 2001-220626, vinylether compound and oxetane compound.

As epoxy compounds, listed are aromatic epoxides, alicyclic epoxides, and aliphatic epoxides as below.

As the aromatic epoxides, listed are di- or polyglycidyl ethers produced via reaction of a polyphenol having at least one aromatic nucleus or an alkylene oxide adduct thereof with epichlorohydrin. For example, listed are di- or polyglycidyl ethers of bisphenol A or an alkylene oxide adduct thereof, di- or polyglycidyl ethers of hydrogenated bisphenol A or an alkylene oxide adduct thereof, and novolac-type epoxy resins. Herein, as the alkylene oxide, ethylene oxide and propylene oxide can be listed.

As the alicyclic epoxides, listed are cyclohexene oxide- or cyclopentene oxide-containing compounds obtained by epoxidizing compounds having at least one cycloalkane ring such as cyclohexene or cyclopentene using an appropriate oxidant such as hydrogen peroxide or a peracid.

The aliphatic epoxides include, for example, di or polyglycidyl ethers of an aliphatic polyol or an alkylene oxide adduct thereof Typical examples thereof include diglycidyl ethers of alkylene glycols such as ethylene glycol diglycidyl ether, propylene glycol diglycidyl ether, or 1,6-hexane diol diglycidyl ether; polyglycidyl ethers of polyols such as di- or triglycidyl ethers of glycerin or an alkylene oxide adduct thereof; and diglycidyl ethers of polyalkylene glycols such as diglycidyl ethers of polyethylene glycol or an alkylene oxide adduct thereof or diglycidyl ethers of polypropylene glycol or an alkylene oxide adduct thereof.

Herein, as the alkylene oxides, ethylene oxide and propylene oxide can be listed.

Of these epoxides, in view of quick curability, aromatic epoxides and alicyclic epoxides can be used. Of these, alicyclic epoxides are preferable.

Herein, the epoxides may be used individually or in combinations of at least two types.

Moreover, in this present invention, in view of the safety such as AMES and sensitization, as epoxy compound having oxiran group, preferred is at least one of epoxidized fatty acid ester and epoxidized fatty acid glyceride.

Epoxidized fatty acid ester and epoxydated fatty acid glyceride can be utilized without specific limitation provided being those in which an epoxy group has been introduced into fatty acid ester and fatty acid glyceride.

As epoxydated fatty acid ester, those prepared by epoxydation of oleic acid ester such as methylepoxystearate, butylepoxystearate and octylepoxystearate are utilized. Further, as epoxydated fatty acid glyceride, similarly those prepared by epoxydation of soybean oil, linseed oil and castor oil; such as epoxydated soybean oil, epoxydated linseed oil and epoxydated castor oil are utilized.

Further, in this invention, to further improve curing ability and ejection stability, as photo polymerizable compound, incorporation of 30-95% by mass of compound having oxetane ring, 5-70% by mass of compound having oxirane group and 0-40% by mass of vinylether compound is preferable.

An oxetane compound utilizable in this invention means a compound having an oxetane ring, and every oxetane compound well known in the art such as disclosed in JP-A Nos. 2001-220526 and 2001-310937 can be utilized.

A vinyl ether compound includes, for example, di- or tri-vinyl ether compounds such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexane dimethanol divinyl ether and trimethylolpropane trivinyl ether; and monovinyl ether compounds such as ethyl vinyl ether, n-butyl vinyl ether, isobutyl vinyl ether, octadecyl ethyl vinyl ether, cyclohexyl vinyl ether, hydroxybutyl vinyl ether, 2-ethylhexyl vinyl ether, cyclohexane dimethanol monovinyl ether, n-propyl vinyl ether, isopropyl vinyl ether, isopropenyl vinyl ether-O-propylene carbonate, dodecyl vinyl ether, diethylene glycol monovinyl ether and octadecyl vinyl ether.

Among these vinyl ether compound, in view of curability, adhesion properties and surface hardness, preferred is di- or tri-vinyl ether compound, most preferred is divinyl ether compound. In the present invention, the vinyl ether compound may be used individually or in combinations of at least 2 types.

As a photo-cationic polymerization initiator usable for the ink of the present invention, well-known photolytically acid generating agents can be used.

As such a photolytically acid generating agent, any compound used, for example, for chemical sensitization-type photoresists and photo-cationic polymerization is used (refer to pages 187-192 of "Imaging Yo Yuki Zairyo (Organic Materials Used for Imaging Applications)" edited by Yuki Electronics Zairyo Kenkyukai published by Bunshin Shuppan (1993). Examples of compounds suitable for the present invention will now be listed.

Initially, there can be listed $B(C_6F_5)^{4-}$, $PF_6^-$, $AsF_6^-$, $SbF_6^-$, and $CF_3SO_3^-$ salts of aromatic onium compounds such as diazonium, ammonium, iodonium, sulfonium, and phosphonium.

Specific examples of such onium compounds usable for the present invention are listed below.

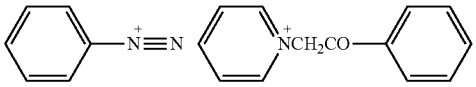

-continued

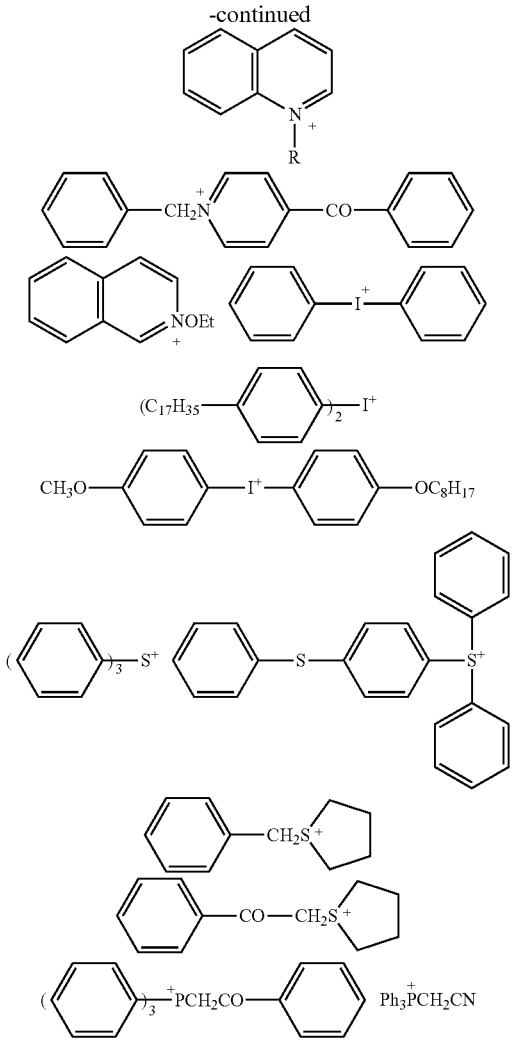

Secondly, sulfonated compounds generating sulfonic acid can be listed and specific compounds will now be exemplified.

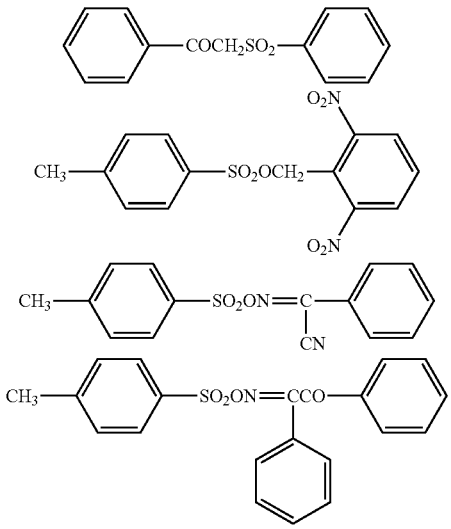

-continued

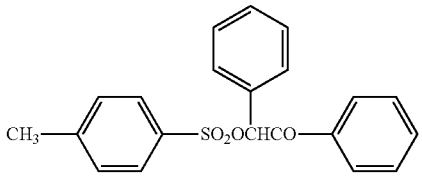

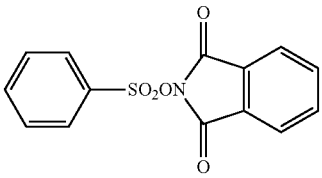

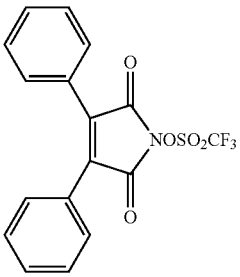

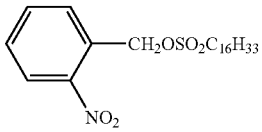

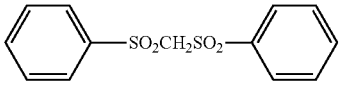

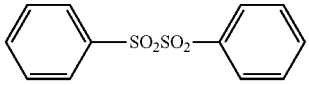

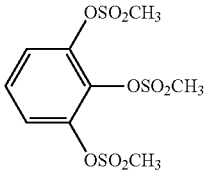

Thirdly, halides photolytically generating hydrogen halides are usable. Specific compounds will now be exemplified.

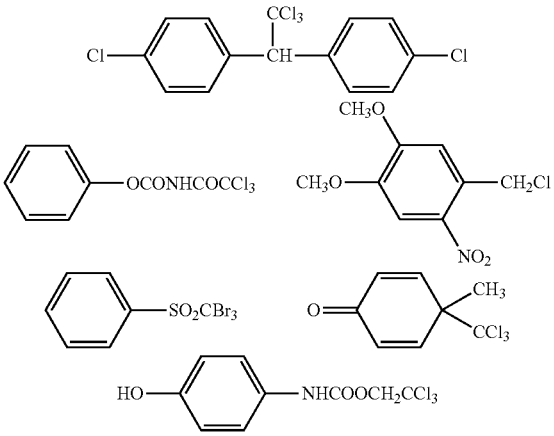

-continued

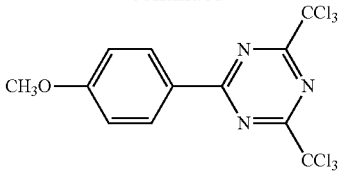

Fourthly, iron-arene complexes can be listed.

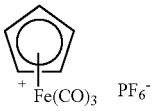

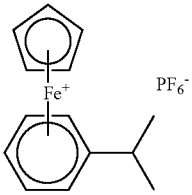

Such a photolytically acid generating agent (a photo-cationic polymerization initiator) is preferably contained at 0.2-20 parts by mass based on 100 parts by mass of a cationically polymerizable compound. When the content of the photo polymerization initiator is less than 0.2 parts by mass, a cured material is difficult to obtain. Even when the content is more than 20 parts by mass, no effect to further enhance curability is produced. These photo-cationic polymerization initiators can be used individually or in combinations of at least two types.

Non-aqueous type actinic energy radiation curable ink comprises a colorant as well as cationic polymerizable compound above.

As a colorant included in the ink of the present invention, a pigment is preferable.

As pigment usable in the present invention, an organic pigment which is surface treated to acidic or basic is preferably used. Content of dispersant in ink is preferably 35-65% based on the mass of the pigment. According to the present invention, when a content of dispersant is less than 35%, dispersion stability may tend to be insufficient because dispersant cannot absorb enough to cover all surface of the pigment. When a content of dispersant exceeds 65%, dispersant which cannot be absorbed on the surface of the pigment may be liberated into ink and may tend to inhibit polymerization. Amine value of the pigment is preferably larger than acid value, more preferably the difference between them is more than 1 mg/g KOH and less than 10 mg/g. In case of less than 1 mg/g KOH, there is no effect and in case of more than 10 mg/g, it is necessary to treat excessively to basic side, resulting in increasing cost and a cause of inhibiting polymerization.

Specific example of pigment usable in the present invention include: carbon-based pigment such as carbon black, carbon refined and carbon nano-tube; metal oxide pigment such as iron black, cobalt blue, titanium oxide, chromium oxide and iron oxide; sulfide pigment such as zinc sulfide; phthalocyanine series pigment; pigment comprising salt such as metal sulfate, metal silicate and metal phosphate; inorganic pigment such as metal powder such as aluminum powder, bronze powder and zinc powder; nitroso pigment such as nitro pigment, aniline black, and naphthol green B; azo pigment (including azo lake, insoluble azo pigment, condensed azo pigment, and chelated azo pigment) such as Bordeaux 10B, Lake red 4R and Chromphthal red; lake pigment such as Peacock blue lake and Rhodamin lake; phthalocyanine pigment such as phthalocyanine blue; polycyclic pigment such as perylene pigment, perinone pigment, anthraquinone pigment, quinacridone pigment, dioxane pigment, thioindigo pigment, isoindolinone pigment, quinofuranone pigment; threne pigment such as thioindigo red and Indanthrene Blue; organic pigment such as quinacridone pigment, quinacridine pigment and isoindolinone pigment.

C. I. Pigment Yellow-1, 2, 3, 12, 13, 14, 16, 17, 42, 73, 74, 75, 81, 83, 87, 95, 97, 98, 109, 114, 120, 128, 129, 138, 150, 151, 154, 180 and 185; C. I. Pigment Orange-16, 36 and 38; C. I. Pigment Red-5, 7, 22, 38, 48:1, 48:2, 48:4, 49:1, 53:1, 57:1, 63:1, 101, 112, 122, 123, 144, 146, 168, 184, 185 and 202; C. I. Pigment Violet-19 and 23; C. I. Pigment Blue-1, 2, 3, 15:1, 15:2, 15:3, 15:4, 18, 22, 27, 29 and 60; C. I. Pigment Green-7 and 36; C. I. Pigment White-6, 18 and 21; and C. I. Pigment Black-7

For dispersion of the above-described pigment, such as a ball mill, a sand mill, an atliter, a roll mill, an agitator, a Henschel mixer, a colloidal mill, an ultrasonic homogenizer, a pearl mill, a wet-type jet mill and a paint shaker can be utilized. Further, at the time of dispersion of pigment, a dispersant can be added. As a dispersant, a polymer dispersant is preferably utilized, and a polymer dispersant includes such as SOLSPERSE siries of Avecia Corp. and PB siries of Ajinomoto Fine-Techno Co., Inc. Further, a synergist as a dispersion aid may be employed depending on various types of pigment. These dispersants and dispersion aids are preferably added at 1-50 parts by mass against 100 parts y mass of pigment. As a dispersion medium, a solvent or a polymerizing compound is utilized; however, in a non-aqueous type actinic energy radiation curable ink composition of this invention, non-solvent is preferable for curing reaction immediately after ink landing. When a solvent remains in a cured image, there caused deterioration of solvent resistance and a problem of VOC of a residual solvent. Therefore, it is preferable to select not a solvent but a polymerizing compound as a dispersion medium, and more preferably to select monomer having the lowest viscosity among them, with respect to dispersion adaptability.

In dispersion of pigment, selection of pigment, a dispersant and a dispersion medium; a dispersing condition and a filtering condition will be appropriately set to make a mean particle size of pigment particles of preferably 0.08-0.5 μm, and the maximum particle size of 0.3-10 μm and preferably 0.3-3 μm. By this particle size control, it is possible to restrain nozzle clogging, and to keep storage stability, transparency and curing sensitivity of ink. In the ink of this invention, in the case of pigment being incorporated, the colorant concentration is preferably not less than 1-10% by mass based on the total ink amount.

Further, in the ink containing cationic polymerizable compound, it is preferable to adjust water content in the rage of 0.5% by mass to 3.0% by mass, in view of enhancing ink storage stability. When water content is less than 0.5% by mass, ink storage stability becomes poor. When water content is more than 3.0% by mass, undesirable result occur such that nozzle clogging increases and results in poor stability of ejection, due to increasing deposits.

(Water-Based Type Actinic Energy Radiation Curable Ink)

As an example of the ink of the present invention, listed is an water-based type actinic energy radiation curable ink comprising an actinic energy radiation polymerizable compound as well as water, colorant and water soluble solvent.

The water-based type actinic energy radiation curable ink related to the present invention is mainly cured by using an ultraviolet ray. In the present invention, it is abbreviated to as Water-based UV ink.

As an actinic energy radiation curable compound applicable to the water-based UV ink related to the present invention, preferred is a polymer compound which has a plurality of side chains to main chain and has capability to crosslink between side chains by irradiating actinic energy radiation (for example, ultraviolet ray). Further, preferred is a polymer compound in which the main chain is saponified polyvinyl acetate and a functional group containing a portion of cross linking or polymerizing to the saponified polyvinyl acetate is bonded.

Herein, the polymer compound to which a functional group containing a portion of cross linking or polymerizing to the saponified polyvinyl acetate is bonded means a polymer compound to which a modified group such as photodimerization type, photodecomposition type, photopolymerization type, photomodification type or photodepolymerization type is introduced.

Saponified polyvinyl acetate may be desirable from the viewpoints of easiness for introducing side chains and handling, and preferably has the saponification degree of 77-99%. Moreover, the average polymerization degree is preferably 200-3,000, more preferably 300-1,500 from the viewpoint of handling.

A conversion rate to the side chain of saponified polyvinyl acetate is preferably 1.0-6.0 mol %, more preferably 1.0-5.0 mol % from the viewpoints of reactivity. In the case of 1.0 mol % or more, enough crosslink can be obtained, and in the case of 6.0 mol % or less, excellent film strength can be obtained.

As the photo-dimerizable type modifying group, preferably used is a group into which a diazo group, a cinnamoyl group, a stilbazonium group, a stilquinolium group, etc. is introduced. For example, a light sensitive resin (composition) described in JP-A No. 60-129742 may be used desirably. The light sensitive resin described in this patent is the compound represented by the following Formula (1) in which a stilbazonium group is introduced into a polyvinyl alcohol structure.

Formula (1)

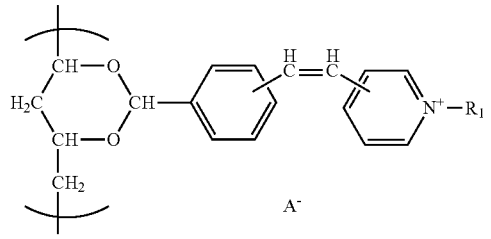

In the formula, $R_1$ represents an alkyl group having a carbon number of 1 to 4, and $A^-$ represents a counter anion.

Further, the modifying group represented by the following Formula (2) is also preferably used:

Formula (2)

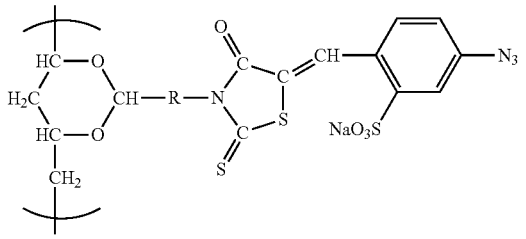

In the formula, R is an alkylene group or an arylene ring, and preferably a phenylene group.

As a photopolymerizable type modifying group, a resin described in JP-A Nos. 2000-181062 and 2004-189841 and represented by the following Formula (3) is also preferable from the viewpoint of reactivity.

Formula (3)

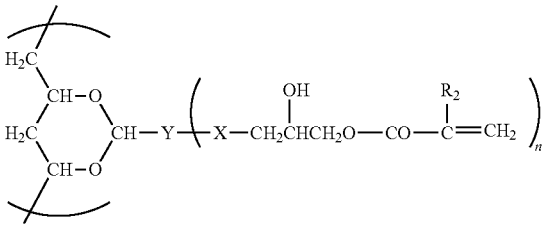

In the formula, $R_2$ represents a methyl group or a hydrogen atom; n is 1 or 2; X represents —$(CH_2)_m$—COO—, —$CH_2$—COO— or —O—; Y represents an arylene group or a single bond; and m is an integer of 0 to 6.

In the ink according to the invention, a water soluble photopolymerization initiator may be preferably employable. These compounds may be in the condition of being dissolved or dispersed in a solvent, or being chemically bonded to an actinic energy radiation crosslinkable polymer compound.

An employable photopolymerization initiator is not limited specifically, however, water-soluble compound is preferably used from the view points of miscibility and reaction efficiency. Specifically, 4-(2-hydroxyethoxy)phenyl-(2-hydroxy-2-propyl)ketone (HMPK), thioxanthon ammonium salt (QTX) and benzophenone ammonium salt (ABQ) are preferably used from the view points of miscibility to water based solvents.

Furthermore, from the viewpoint of compatibility with resin, compounds represented by the following Formula (4), such as 4-(2-hydroxyethoxy)phenyl-(2-hydroxy-2-propyl) ketone (n=1, HMPK) and its ethylene oxide adduct (n=2-5) are more preferable.

Formula (4)

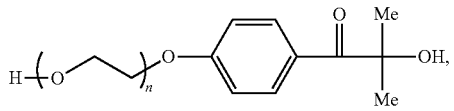

wherein n is an integer of 1 to 5.

Furthermore, examples of other preferred photopolymerization initiators include benzophenones such as benzophenone, hydroxybenzophenone, bis-N,N-dimethylaminobenzophenone, bis-N,N-diethylaminobenzophenone and 4-methoxy-4'-dimethylaminobenzophenone; thioxanthones such as thioxanthone, 2,4-diethylthioxantone, isopropylthioxantone, chlorothioxanthone and isopropoxychlorothioxanthone; anthraquinones such as ethylanthraquinone, benzanthraquinone, aminoanthraquinone, and chloroanthraquinone; acetophenones; benzoin ethers such as benzoin methyl ether; 2,4,6-trihalomethyltriazines; 1-hydroxycyclohexylphenyl ketone; 2,4,5-triarylimidazole dimmers such as 2-(o-chlorophenyl)-4,5-diphenylimidazole dimmer, 2-(o-chlorophenyl)-4,5-di-(m-methoxyphenyl)imidazole dimmer, 2-(o-fluorophenyl)-4,5-diphenylimidazole dimmer, 2-(o-methoxyphenyl)-4,5-diphenylimidzole dimmer, 2-(p-methoxyphethyl)-4,5-diphenylimidazole dimmer, 2-di(p-methoxyphenyl)-5-phenylimidazole dimmer and 2-(2,4-dimethoxyphenyl)-4,5-diphenylimidazole dimmer; benzyl dimethyl ketal, 2-benzyl-2-dimethylamino-1-(4-morpholinophenyl)butane-1-one, 2-methyl-1-[4-(methylthio)phenyl]-2-morpholino-1-propane, 2-hydroxy-2-methyl-1-phenyl-propane-1-one, 1-[4-(2-hydroxyethoxy)-phenyl]-2-hydroxy-2-methyl-propane-1-one, phenanthrenequinone, 9,10-phenthrenequinone; benzoins such as methylbenzoin and ethylbenzoin; acridine derivatives such as 9-phenylacridine and 1,7-bis(9,9'-acridinyl)heptane; bisacylphosphine oxide; and mixtures of these compounds. These compounds may be used alone or in combination.

In addition to these photopolymerization initiators, accelerators may be incorporated. Examples the accelerators include ethyl p-dimethylaminobenzoate, isoamyl p-dimethylaminobenzoate, ethanolamine, diethanolamine and triethanolamine.

These photopolymerization initiators may preferably be grafted to saponified polyvinyl acetate.

A molecular weight increasing effect per photon is remarkably larger in the actinic energy radiation curable resin of the present invention, because crosslinking occurs through crosslinking bonds or functional group containing polymerizable position to saponified polyvinyl acetate originally having some degree of polymerization. On the other hand, in the well-known actinic energy radiation curable resin, number of crosslinking points cannot be controlled. Therefore, film property after curing cannot be controlled resulting in obtaining hard and brittle film.

In the resin of the invention, the number of crosslinking points can be thoroughly controlled by the length of saponified polyvinyl acetate and the introduced amount of crosslinking bonds or functional group containing polymerizable position. Therefore, the physical property of an ink layer can be controlled in correspondence with an object.

In water-based type actinic energy radiation curable ink, pigment listed in the pigment for non-aqueous type actinic energy radiation curable ink can be employable as colorant. Further, dye listed below can be preferably employable.

As dye employable to the present invention, preferred is water soluble dye and acid dye, basic dye and reactive dye are included. Especially preferred dye is:

C.I. Direct Red 2, 26, 31, 62, 63, 72, 75, 76, 79, 80, 81, 83, 84, 89, 92, 95, 111, 173, 184, 207, 211, 212, 214, 218, 221, 223, 224, 225, 226, 227, 232, 233, 240, 241, 242, 243, 247;

C.I. Direct Violet 7, 9, 47, 48, 51, 66, 90, 93, 94, 95, 98, 100, 101;

C.I. Direct Yellow 8, 9, 11, 12, 27, 28, 29, 33, 35, 39, 41, 44, 50, 53, 58, 59, 68, 86, 87, 93, 95, 96, 98, 100, 106, 108, 109, 110, 130, 132, 142, 144, 161, 163;

C.I. Direct Blue 1, 10, 15, 22, 25, 55, 67, 68, 71, 76, 77, 78, 80, 84, 86, 87, 90, 98, 106, 108, 109, 151, 156, 158, 159, 160, 168, 189, 192, 193, 194, 199, 200, 201, 202, 203, 207, 211, 213, 214, 218, 225, 229, 236, 237, 244, 248, 249, 251, 252, 264, 270, 280, 288, 289, 291;

C.I. Direct Black 9, 17, 19, 22, 32, 51, 56, 62, 69, 77, 80, 91, 94, 97, 108, 112, 113, 114, 117, 118, 121, 122, 125, 132, 146, 154, 166, 168, 173, 199;

C.I. Acid Red 35, 42, 52, 57, 62, 80, 82, 111, 114, 118, 119, 127, 128, 131, 143, 151, 154, 158, 249, 254, 257, 261, 263, 266, 289, 299, 301, 305, 336, 337, 361, 396, 397;

C.I. Acid Violet 5, 34, 43, 47, 48, 90, 103, 126;

C.I. Acid Yellow 17, 19, 23, 25, 39, 40, 42, 44, 49, 50, 61, 64, 76, 79, 110, 127, 135, 143, 151, 159, 169, 174, 190, 195, 196, 196, 197, 199, 218, 219, 220, 222, 227;

C.I. Acid Blue 9, 25, 40, 41, 62, 72, 76, 78, 80, 82, 92, 106, 112, 113, 120, 127:1, 129, 138, 143, 175, 181, 205, 207, 220, 221, 230, 232, 247, 258, 260, 264, 271, 277, 278, 279, 280, 288, 290, 326;

C.I. Acid Black 24, 29, 48, 52:1, 172;

C.I. Reactive Red 3, 13, 17, 21, 22, 23, 24, 29, 35, 37, 40, 41, 43, 45, 49, 55;

C.I. Reactive Violet 1, 3, 4, 5, 6, 7, 8, 9, 16, 17, 22, 23, 24, 26, 27, 33, 34;

C.I. Reactive Yellow 2, 3, 14, 15, 17, 18, 23, 24, 25, 26, 27, 29, 41, 42;

C.I. Reactive Blue 2, 3, 5, 8, 10, 13, 14, 15, 17, 18, 19, 21, 25, 27, 28, 29, 38;

C.I. Reactive Black 4, 5, 8, 14, 21, 23, 26, 31, 32, 34;

C.I. Basic Red 12, 13, 14, 15, 18, 22, 23, 24, 25, 27, 29, 35, 36, 38, 39, 45, 46;

C.I. Basic Violet 1, 2, 3, 7, 10, 15, 16, 20, 21, 25, 27, 28, 35, 37, 39, 40, 48;

C.I. Basic Yellow 1, 2, 4, 11, 13, 14, 15, 19, 21, 23, 24, 25, 28, 29, 32, 39, 36, 39, 40;

C.I. Basic Blue 1, 3, 5, 7, 9, 22, 26, 41, 45, 46, 47, 54, 57, 60, 62, 65, 66, 69, 71; and C.I. Basic Black 8.

Preferable specific disperse dyes are listed below:

C.I. Disperse Yellow 3, 4, 42, 71, 79, 114, 180, 199, 227,

C.I. Disperse Orange 29, 32, 73;

C.I. Disperse Red 11, 58, 73, 180, 184, 185, 283;

C.I. Disperse Violet 1, 26, 48; and

C.I. Disperse Blue 73, 102, 167, 184.

According to the present invention, water-soluble resins, as described below are preferably employed. Examples include styrene-acrylic acid-alkyl acrylate copolymer, styrene-acrylic acid copolymer, styrene-maleic acid copolymer, styrene-maleic acid-alkyl acrylate copolymer, styrene-methacrylic acid copolymer, styrene-methacrylic acid-alkyl acrylate copolymer, styrene-maleic acid half ester copolymer, vinylnaphthalene-acrylic acid copolymer, and vinylnaphthalene/maleic acid copolymer.

A water-based liquid medium is preferably used in a water-based actinic energy radiation curable ink in the invention. Such an aqueous liquid medium (or aqueous solvent) is preferably a mixture of water and water-soluble organic solvents. Examples of a preferable water-soluble organic solvent include alcohols (e.g., methanol, ethanol, propanol, isopropanol, butanol, isobutanol, secondary butanol, tertiary butanol, pentanol, hexanol, cyclohexanol and benzyl alcohol); polyhydric alcohols (e.g., ethylene glycol, diethylene glycol, triethylene glycol, polyethylene glycol, propylene glycol, dipropylene glycol, polypropylene glycol, butylenes glycol, hexane-diol, pentane-diol, glycerin, hexane-triol, thiodiglycol), polyhydric alcohol ethers (e.g., ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monomethyl ether, propylene glycol monobutyl ether, ethylene glycol monomethyl ether acetate, triethylene glycol monomethyl ether, triethylene glycol monoethyl ether, triethylene glycol monobutyl ether, ethylene glycol monophenyl ether, propylene glycol monophenyl ether); amines (e.g., ethanolamine, diethanolamine, triethanolamine, N-methyldiethanolamine, N-ethyldiethanolamine, morpholine, N-ethylmorpholine, ethylenediamine, diethylenediamine, triethylenetetramine, tetraethylenepentamine, polyethyleneimine, pentamethyldiethylenetriamine, tetramethylpropylenediamine); amides (e.g., formamide, N,N-dimethylformamide, N,N-dimethylacetoamide); heterocycles (e.g., 2-pyrrolidone, N-methyl-2-pyrrolidone, cyclohexylpyrrolidone, 2-oxazolidone, 1,3-dimethyl-2-imidazolidinone) and sulfoxides (e.g., dimethylsulfoxide). As preferable water-soluble organic solvent, polyalcohols are listed. Further, polyalcohol and polyalcohol ether are employed preferable in combination.

Water-soluble organic solvent may be employed individually or in combinations of at least two types. Content of water-soluble organic solvent in ink is 5-60% by mass in total, preferably 10-35% by mass.

(Irradiation of Actinic Energy Radiation)

According to the present invention, after ejecting ink which contains curable compound by actinic energy radiation such as ultraviolet ray onto the recording medium by using inkjet head, ink is set to increase viscosity (cured) by irradiating actinic energy radiation.

Actinic energy radiation related t the present invention include, for example, electron beam, ultraviolet ray, $\alpha$ ray, $\beta$ ray, $\gamma$ ray and X ray. Among them, ultraviolet ray is preferable from the standpoint of smaller risk to human body, easiness to handle and being in widespread industrial use.

As a light source of ultraviolet ray, for example, a low-pressure, a middle-pressure, a high-pressure mercury lamp having operating pressure of 100 Pa-1 MPa is employed. Among them, a high-pressure mercury lamp and a metal halide lamp are preferable from the standpoint of wavelength distribution of light source.

Specifically, in the case radiation energy of 10 mJ/cm$^2$ or more, sufficient effect of the present invention can be obtained due to excellent cross linking efficiency. Therefore, output of the lamp is 500 W-30 kW, illuminance is 10 mW/cm$^2$-1,000 W/cm$^2$, preferably 10 mW/cm$^2$-200 W/cm$^2$. Radiation energy of the present invention is 10-1,000 mJ/cm$^2$.

[Water-Based Pigment Ink]

Water-based pigment ink which comprises at least water, water-soluble organic solvent and pigment is listed as one of example of the ink of the present invention.

As for pigment, the same pigment described above can be listed. Further, as for water-soluble organic solvent, the same water-soluble organic solvent described above can be listed.

(Water-Based Fixing Ink)

Among water-based pigment ink, water-based fixing ink (fixing type water-based pigment ink) having constitution below is preferable from the standpoint of printability onto the non-absorbable recording medium.

Herein, water-based fixing ink related to the present invention means the ink which comprises at least pigment, ink-soluble resin and water-soluble organic solvent, and has printability onto the non-absorbable recording medium by heat treatment after printing.

Pigment employable to water-based ink may be stably dispersible into water-based and can be selected from pigment dispersion by polymer resin, encapsulated pigment covered by water insoluble resin, and self-dispersing pigment which is dispersible without using dispersing resin due to modifying surface of pigment. When a storage stability of ink is especially emphasized, encapsulated pigment covered by water insoluble resin can be selected. As for employable pigment, the same species is listed which is usable to above non-water-based actinic energy radiation curable ink.

(Ink-Soluble Resin)

The water-based fixing ink of the present invention preferably contains an ink-soluble resin in an amount of 2 mass % to 10 mass %. Herein, an ink-soluble resin according to the present invention is a resin which has a solubility of at lest about 10% in an ink vehicle.

An ink-soluble resin according to the present invention has a function of a binder resin for improving durability of an image. Therefore, the ink-soluble resin is preferably a resin stably dissolved in the ink, and it is preferable that the ink-soluble resin is provided with a water resisting property after the ink is dried on the recording medium.

As an example of such resin, there is designed and used a resin having a hydrophobic component and a hydrophilic component with an appropriate balance. For a hydrophilic component, it may be used either an ionic component or a non-ionic component, but preferably used is an ionic component, and more preferably used is an anionic component. In particular, it is preferable to use a resin having an anionic component which is provided with water solubility by being neutralized with a basic component capable of being evaporated. A specifically preferable ink-soluble resin contains a carboxyl group or a sulfonic group as an acid group and has an acid value of from 80 mg/KOH to less than 300 mg/KOH in order to achieve the effects of the present invention. More preferable acid value is in the range of about 90 mg/KOH to about 200 mg/KOH. An acid value is defined as an amount of potassium hydroxide measured in milligram required to neutralize an acidic component contained in one gram of a resin.

Examples of such resin are cited as: an acrylic resin, a styrene-acrylic resin, an acrylonitrile-acrylic resin, a vinyl acetate-acrylic resin, a polyurethane resin and a polyester resin.

As a rein, a resin containing both a hydrophobic monomer and a hydrophilic monomer can be used.

Examples of a hydrophobic monomer are cited as: an acrylic acid ester (for example, n-butyl acrylate, 2-ethyl hexyl acrylate and 2-hydroxyethyl acrylate); a methacrylic acid ester (for example, ethyl methacrylate, butyl methacrylate and glycidyl methacrylate); and styrene.

Examples of a hydrophilic monomer are cited as: acrylic acid, methacrylic acid and acrylamide. The monomer having an acid group in the molecule such as acrylic acid is preferably used after neutralized with a base after being polymerized.

As a molecular weight of a resin, an average molecular weight of 3,000 to 300,000 can be used. And preferably, an average molecular weight of 7,000 to 200,000 can be used.

The resin having Tg of from about −30° C. to 100° C. can be used. And preferably, the resin having Tg of from about −10° C. to 80° C. can be used.

As a polymerization method, a solution polymerization method is preferably used.

It is preferable that the acid group originated from an acidic monomer used for preparing the resin is partially or fully neutralized with a basic component. Examples of neutralizing bases are: a base containing an alkaline metal for example, sodium hydroxide, potassium hydroxide; and amines (for example, ammonia, alkanolamine and alkylamine can be used). In particular, it is preferable to neutralize with an amine having a boiling pint of less than 200° C. from the viewpoint of improving durability of an image.

An amount of the resin added in the ink is from 2% to 10% in order to obtain the effect of the present invention. More preferably, it is used by adding in the ink from 3% to 6%.

Furthermore, in the above-mentioned way, it is important to incorporate an ink-soluble resin as a binder resin in an amount of 2 mass % to 10 mass % as a solid content. When the amount of the ink-soluble resin is less than 2 mass %, the extent of the increase of the viscosity of the ink will be limited and the effect of preventing the mixing of the ink will be insufficient to obtain an image of high quality. When the added amount of the ink-soluble resin is more than 10 mass %, storage stability and ejection stability of the ink will be decreased.

(Water-Soluble Organic Solvent)

In water-based fixing ink, content of water-soluble organic solvent at least selected from glycol ether or 1,2-alkanediol is preferably 20% by mass or more and 45% by mass or less, more preferably 25% by mass or more and less than 40% by mass. The solvent may be used individually 20% by mass or more and less than 45% by mass or may be used in total of a plurality of types 20% by mass or more and less than 45% by mass.

Specific examples include glycol ethers such as ethylene glycol monoethyl ether, ethylene glycol monobutyl ether, diethylene glycol monoethyl ether, diethylene glycol monobutyl ether, triethylene glycol monobutyl ether, propylene glycol monopropyl ether, dipropylene glycol monomethyl ether, and tripropylene glycol monomethyl ether.

Further, as for 1,2-alkanediol, 1,2-butanediol, 1,2-pentanediol, 1,2-hexanediol and 1,2-heptanediol is listed.

Water-soluble organic solvent described above can be added to water-based fixing ink, other than glycol ether or 1,2-alkanediol.

(Surfactant)

Silicone based or fluorine based surfactant is preferably usable to water-based fixing ink. It is desirable to obtain wettability to various recording medium by using glycol ether or 1,2-alkanediol, and silicone based or fluorine based surfactant.

Examples of silicone based surfactant is preferably polyether modified poly siloxane, for example, such as KF-351A, KF-642 (produced by Shin-Etsu Chemical Co., Ltd.) and BYK347 and BYK348 (produced by BYK-Chemie Japan KK).

Fluorine based surfactant means that hydrogen which is bonded to carbon in hydrophobic group in general surfactant is partially or all substituted by fluorine. Among them, preferred is a surfactant having perfluoroalkyl group within molecule.

Examples of fluorine based surfactant are commercially available as "Megafac F" from Dainippon Ink and Chemicals, Inc., "Surflon" from Asahi glass Co., Ltd., "Fluorad" from Minnesota Mining and Manufacturing, "Monflor" from Imperial Chemical Industries, "Zonyls" from E.I. DuPont as well as "Licowet VPF" from Farbwerke Heochest AG under the trade names.

As for non-ionic fluorine based surfactant, for example, Megafac 144D (produced by Dainippon Ink and Chemicals, Inc.) and Surflon S-141, S-145 (produced by Asahi glass Co., Ltd.) is listed. As for amphoteric fluorine based surfactant, for example, Surflon-131 and S-132 (produced by Asahi glass Co., Ltd.) is listed.

(Other Water-Based Ink)

Further, as a water-based ink, water-based ink (hereinafter, it is referred to as water-based ink B) is employed which has printability onto an absorbable recording medium (for example, paper recording medium such as plain paper, coated paper or art paper).

In this water-based ink B, preferred is constitution in which at least water, water-soluble organic solvent and pigment are incorporated and amount of water is 10% by mass or more and less than 50% by mass with respect to the total ink mass as well as an amount of water-soluble organic solvent having SP value ($(MPa)^{1/2}$) of 16.5 or more and less than 24.6 is 30% by mass or more based on total ink mass.

Amount of water is preferably 10% by mass or more and less than 50% by mass with respect to the total ink mass, more preferably 20% by mass or more and less than 40% by mass.

Water-based ink B applicable to the present invention preferably has 30% by mass or more of water-soluble organic solvent having SP value ($(MPa)^{1/2}$) of 16.5 or more and less than 24.6, based on total ink. In the case of the content being 30% by mass or more, curl and cockling can be effectively suppressed in recording onto plain paper. In the case of SP value ($(MPa)^{1/2}$) of the organic solvent being 16.5 or more, compatibility with water can be kept and organic solvent is not separated. Further, organic solvent having less than 24.6 of SP value ($(MPa)^{1/2}$) exhibits sufficient suppression of curl. Thus, SP value ($(MPa)^{1/2}$) of the organic solvent is more preferably 16.5 or more and less than 22.5.

"Solubility parameter (SP value)", as described in the present invention, is the value represented by the square root of molecular cohesive energy, and values are employed which are calculated by the method described in R. F. Fedors, Polymer Engineering Science, 14, p 147 (1974). Units are $(MPa)^{1/2}$ and values refer to those at 25° C.

Examples of water-soluble organic solvent having SP value ($(MPa)^{1/2}$) of 16.5 or more and less than 24.6 are listed below with SP value ($(MPa)^{1/2}$).

Ethylene glycol monomethyl ether (SP value $(MPa)^{1/2}$): 24.5)

Ethylene glycol monoethyl ether (23.5)
Ethylene glycol monobutyl ether (22.1)
Ethylene glycol monoisopropyl ether (22.3)
Diethylene glycol monomethyl ether (23.0)
Diethylene glycol monoethyl ether (22.4)
Diethylene glycol monobutyl ether (21.5)
Diethylene glycol diethyl ether (16.8)
Triethylene glycol monomethyl ether (22.1)
Triethylene glycol monoethyl ether (21.7)
Triethylene glycol monobutyl ether (21.1)
Propylene glycol monomethyl ether (23.0)
Propylene glycol monophenyl ether (24.2)
Dipropylene glycol monomethyl ether (21.3)
Tripropylene glycol monomethyl ether (20.4)
1,3-dimethyl-2-imidazolidine (21.8)

Further, in water-soluble organic solvent having SP value ($(MPa)^{1/2}$) of 16.5 or more and less than 24.6, preferred is amount of water-soluble organic solvent 30% by mass or more based on total ink mass in which water-soluble organic solvent has vapor pressure of 0.01 Pa or more and 133 Pa or less, more preferably has vapor pressure of 0.01 Pa or more and 66 Pa or less. Specific examples of water-soluble organic solvent which satisfy these conditions, include tripropylene glycol monomethyl ether (3.99 Pa), triethylene glycol monomethyl ether (less than 1.33 Pa), triethylene glycol monobutyl ether (less than 1.33 Pa), diethylene glycol monomethyl ether (24.00 Pa), and diethylene glycol monoethyl ether (17.33 Pa).

In the present invention, various kind of water-soluble organic solvent described in water-based actinic energy radiation curable ink can be used in combination, as well as above water-soluble organic solvent.

In water-soluble organic solvent related to water-based ink B, preferred is to employ solvent which exhibits the maximum point of the viscosity depending on the resultant mixing ratio when solvents are mixed with water. Further, from standpoint of ejection or decap, to mix water with water-soluble organic solvent at a neighborhood of the mixing ratio of the maximum point is more preferable embodiment. Herein, neighborhood is referred to being within 10% of the mixing ratio of the maximum point based on the total mass of water and water-soluble organic solvent being 100%. For example, when the maximum point of the viscosity is achieved at the mixing ratio of water to water-soluble organic solvent at 50:50, from 40:60 to 60:40 is referred to be the neighborhood Specific examples of solvent which exhibit the maximum point of the viscosity depending on the mixing ratio by mixing with water include: ethylene glycol monoalkyl ethers (e.g., ethylene glycol monomethyl ether, ethylene glycol monoethyl ether, and ethylene glycol monobutyl ether); diethylene glycol monoalkyl ethers (e.g., diethylene glycol monomethyl ether, diethylene glycol monoethyl ether, and diethylene glycol monobutyl ether); triethylene glycol monoalkyl ethers (e.g., triethylene glycol monomethyl ether, triethylene glycol monoethyl ether, and triethylene glycol monobutyl ether); propylene glycol monoalkyl ethers (e.g., propylene glycol monomethyl ether, propylene glycol monoethyl ether, and propylene glycol monobutyl ether); dipropylene glycol monoalkyl ethers (e.g., dipropylene glycol monomethyl ether, dipropylene glycol monoethyl ether, and dipropylene glycol monobutyl ether); tripropylene glycol monoalkyl ethers (e.g., tripropylene glycol monomethyl ether, tripropylene glycol monoethyl ether; and tripropylene glycol monobutyl ether. Of these, preferred are dialkylene glycol monoalkyl ethers or trialkylene glycol monoalkyl ethers.

As for pigment usable in the present invention, the same kind of pigment described in non-water-based actinic energy radiation curable ink above can be listed.

[Other Additives to Ink]

In the inks as explained above, other than those described above, if required, in response to targets to enhance various types of performance such as ejection stability, adaptability to print heads and ink cartridges, storage stability, or image retention properties, various known additives such as a viscosity controlling agent, a resistivity controlling agent, a film forming agent, a UV absorbing agents, an antioxidant, an anti-fading agent, an antifungal agent, or an anti-corrosive agent may be appropriately selected and employed. Examples include minute oil droplets such as liquid paraffin, dioctyl phthalate, tricresyl phosphate, or silicone oil; UV absorbers described in JP-A Nos. 57-74193, 57-87988, 62-261476; anti-fading agents described in JP-A Nos. 57-74192, 57-87989, 60-72785, 61-146591, 1-95091, and 3-13376; and optical brightening agents described in JP-A Nos. 59-42993, 59-52689, 62-280069, 61-242871, and 4-219266.

<<Fixing Liquid>>

The present invention is characterized in that fixing liquid is used together with ink for a purpose of enhancing fixtures of the ink to an inkjet recording medium.

As the fixing liquid of the present invention, water-based fixing liquid is also used in case where a corresponding ink is a water-based ink such as, for example, a water-based active actinic energy radiation curable ink, a water-based fixing ink, and a water-based pigment ink; and non water-based fixing liquid is also used in case where a corresponding ink is a non water-based ink such as, for example, a non water-based active actinic energy radiation curable ink.

The details of the fixing liquid of the present invention will be described below using a water-based fixing liquid as an example.

In the present invention, the fixing liquid is not particularly limited as long as the fixing liquid is provided with a characteristic of thickening or coagulating inks deposited on the recording medium, but it is preferable to use fixing liquid containing a polyvalent metal salt or polyallylamine described below, or fixing liquid containing an organic acid.

[Fixing Liquid Containing Polyvalent Metal Salt or Polyallylamine]

The present invention is characterized in that an ink incorporating a pigment, water, or other additives is contained together with as fixing liquid incorporating a polyvalent metal salt or polyallylamine which thickens or coagulates the aforesaid ink.

The fixing liquid of the present invention is characterized in that the fixing liquid is provided with a characteristic of thickening or coagulating ink when the fixing liquid is associated with ink, and the aforesaid fixing liquid incorporates a polyvalent metal salt or polyallylamine, and by inkjet printing the aforesaid ink and fixing liquid on the recording medium, ink is thickened or coagulated at the time before being cured by irradiation of active energy ray, whereby generation of white streaks can be prevented.

The fixing liquid incorporating a polyvalent metal salt or polyallylamine (including polyallylamine derivatives) which are usable in the present invention is thickened or coagulated when contacting with the above ink. Any polyvalent metal salt or polyallylamine may be used as long as they have a function to destroy the dispersed state or dissolved state of pigments or water-soluble polymer compounds to coagulate them.

The preferable example of the polyvalent metal salt includes a water soluble salt which is constituted of a polyvalent metal ion having two or more valences and an anion which is joined with the polyvalent metal ion. The specific examples of the polyvalent metal ion include, as a cation, a bivalent metal ion such as $Ca^{2+}$, $Cu^{2+}$, $Ni^{2+}$, $Mg^{2+}$, $Zn^{2+}$ and $Ba^{2+}$, and a trivalent metal ion such as $Al^{3+}$ and $Fe^{3+}$. And, as an anion, $Cl^-$, $NO_3^-$, $I^-$, $Br^-$, $ClO_3^-$ and $CH_3COO^-$ are included.

$Ca^{2+}$ or $Mg^{2+}$ is particularly preferred. The concentration of these polyvalent metal salts in the fixing liquid is about 0.1 to about 40% by mass, and further preferably 5 to 25% by mass.

The preferred embodiment of the polyvalent metal salt used in the present invention includes an embodiment which is constituted of the above polyvalent metal ion and a nitrate or carboxylate ion which is joined with the above polyvalent metal ion, and is water soluble.

The carboxylate ion is preferably derived from a saturated aliphatic monocarboxylic acid having a carbon number of 1 to 6, or a carbocyclic monocarboxylic acid having a carbon number of 7 to 11.

The particularly preferred example of the saturated aliphatic monocarboxylic acid having a carbon number of 1 to 6 includes a formic acid and an acetic acid, and a hydrogen atom on the saturated aliphatic hydrocarbon of the monocarboxylic acid may be substituted by a hydroxyl group. The preferred example of such a carboxylic acid includes a lactic acid.

The preferred example of the carbocyclic monocarboxylic acid having a carbon number of 7 to 11 includes a benzoic acid.

As the polyallylamine incorporated in the fixing liquid, polyallylamine derivatives are also included. These are water-soluble cationic polymers, and are positively charged in water. The polyallylamines include, for example, compounds represented by Formulae (a), (b), or (c) below.

Formula (a)

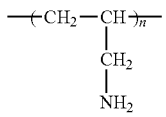

Formula (b)

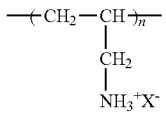

Formula (c)

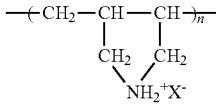

In each of the above Formulae, $X^-$ is a chloride ion, a bromide ion, an iodide ion, a nitric ion, a phosphoric ion, a sulfuric ion or a acetic ion.

The content of these polyallylamines is about 0.5 to about 10% by mass of the fixing liquid.

The fixing liquid of the present invention contains water and/or an aqueous solvent as aqueous vehicle, together with the polyvalent metal salt or the polyallylamine. As the aforesaid aqueous solvent, usable are solvents similar to those used in ink, which is used in combination with the fixing liquid, and the content thereof is about 1 to about 60% by mass.

[Fixing Liquid Containing Organic Acid]

The organic acid, which can be contained in the fixing liquid of the present invention, is not particularly limited, but preferably usable thereof are, for example, compounds having a cyclic structure represented by Formula (A) or Formula (B) below.

Formula (A)

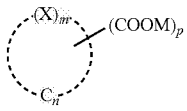

In above Formula (A), X represents O, CO, NH, NR, S, or $SO_2$, and R represents an alkyl group. R is preferably $CH_3$, $C_2H_5$, or $C_2H_4OH$. X is preferably CO, NH, NR, or O, and more preferably CO, NH, or O. M represents a hydrogen atom, an alkali metal, or amines. M preferably includes H, Li, Na, K, a monoethanolamine, a diethanolamine, or a triethanolamine, more preferably H, Na, or K, and further preferably a hydrogen atom. n is an integer of 3 to 7. n is preferably an integer where the heterocycle becomes a six-membered ring or a five-membered ring, and more preferably an integer where it becomes a five-membered ring. m is 1 or 2. The compound represented by Formula (A) may be a saturated or unsaturated ring, as long as it is a heterocycle. p is an integer of 1 to 5.

The specific compound represented by Formula (A) is a compound having a structure of furan, pyrrole, pyrroline, pyrrolidone, pyrone, thiophene, indole, pyridine, or quinoline, and, in addition to that, having a carboxyl group as a functional group.

The compound represented by Formula (A) is preferably pyrrolidone carboxylic acid, pyrone carboxylic acid, pyrrole carboxylic acid, furan carboxylic acid, pyridine carboxylic acid, coumalic acid, thiophenecarboxylic acid, nicotinic acid, or derivatives or salts of these compounds. More preferred compound includes pyrrolidone carboxylic acid, pyrone carboxylic acid, furan carboxylic acid, coumalic acid, or derivatives or salts of these compounds.

Compounds represented by Formula (A) may be used individually or in combination of two or more.

Next, compounds having a cyclic structure represented by Formula (B) will be described.

Formula (B)

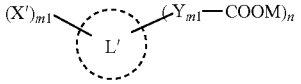

In above Formula (B), X' represents a hydrocarbon group, an alkyloxy group, —OH, —$NH_2$, —$NR_1$, —$COOR_1$, or —$SO_3H$, all of which may have a substituent. $R_1$ represents an alkyl group. Y represents a hydrocarbon group, which may have a substituent, and one or more carbon atoms constituting the hydrocarbon group may be substituted with other atom or an atomic group. M represents a hydrogen atom, an alkaline metal, or amines. m1 is an integer of 0 to 3. n is an integer of 1 to 4. The ring structure L' represents a saturated or unsaturated cyclic structure, in which one or more carbon atoms constituting L' may be substituted with an atom of O, N, or S, or an atomic group of CO, NH, or $NR_3$. $R_3$ represents an alkyl group, an alkenyl group, an alkenylidene group, or an alkylene group.

The hydrocarbon group represented by X', which may have a substituent, preferably has the total carbon number of 1 to 8, and more preferably 1 to 6. The specific examples thereof include a methyl group, an ethyl group, a propyl group, a butyl group, a penthyl group, a hexyl group, and cyclohexyl group, but a methyl group, or an ethyl group is preferred.

The alkyloxy group represented by X' preferably has the total carbon number of 1 to 8, and more preferably 1 to 6. The specific examples thereof include a methoxy group, an ethoxy group, a propoxy group, a butoxy group, an isopropoxy group, an isobutoxy group, a sec-butoxy group, a tert-butoxy group, a pentoxy group, and a fonoxy group, but a methoxy group, an ethoxy group, or a propoxy group is preferred.

The alkyl group represented by $R_1$ preferably has the total carbon number of 1 to 4, and more preferably 1 to 3. The specific examples thereof include a methyl group, an ethyl group, a propyl group, a butyl group, but a methyl group, an ethyl group, or a propyl group is preferred.

The hydrocarbon group represented by Y, which may have a substituent, preferably has the total carbon number of 1 to 4, and more preferably 1 to 3. The specific examples thereof include a methyl group, an ethyl group, a propyl group, and a butyl group, but a methyl group, an ethyl group, or a propyl group is preferred.

Further, the hydrocarbon group represented by Y, which may have a substituent, and one or more carbon atoms constituting the hydrocarbon group may be substituted with other atom or an atomic group. The aforesaid other atom or atomic group includes an oxygen, or a sulfur.

The alkali metal represented by M includes a sodium, a potassium, or a lithium, but a sodium, or a lithium is preferred.

The amines represented by M include monoethanolamine, diethanolamine, or triethanolamine, but diethanolamine, or triethanolamine is preferred.

The ring structure L' is not particularly limited as long as it represents a saturated or unsaturated ring, but is preferably has the total carbon number of 3 to 10, more preferably 3 to 6, and further preferably 4 to 5. The specific examples thereof include cyclopropane, cyclobutane, cyclopentane, cyclopentene, cyclohexane, cyclohexene, benzene, indene, naphthalene, azulene, fluorene, phenanthrene, or anthracene, but cyclobutane, cyclopentane, or cyclopentene is preferred.

Further, one or more carbon atoms constituting the ring structure L' may be substituted with an atom of O, N, or S, or an atomic group of CO, NH, or $NR_3$. $R_3$ represents an alkyl group (for example, methyl group, ethyl group, or propyl group), an alkenyl group (for example, vinyl group, propenyl group, or allyl group), an alkenylidene group (for example, methylene group, or ethylidene group), or an alkylene group (for example, methylene group, ethylene group, or trimethylene group).

m1 is preferably an integer of 1 to 3. n is preferably an integer of 1 to 3. Each of the two m1s may have a different integer.

The organic acid having the ring structure represented by Formula (B) may further be an organic acid in which, among carbon atoms constituting the ring structure L1 in Formula (B), at least one carbon atom is substituted by CO, and at least one carbon atom is substituted by NH.

Of the organic acids having the ring structure represented by above Formula (B), particularly preferable examples include 2-pyrrolidone-5-carboxylic acid, furancarboxylic acid, 2-pyrrolidinecarboxylic acid, 3-pyridinecarboxylic acid, or 4-piperidinecarboxylic acid.

The amount of the organic acid contained in the fixing liquid of the present invention is about 0.01 to about 30% by mass.

The fixing liquid of the present invention can contains water and/or an aqueous solvent as aqueous vehicle, together with the organic acid. As the aqueous solvent of the present invention, usable are solvents similar to those used in ink composite, which is used in combination with the fixing liquid, and the content thereof is about 1 to about 60% by mass.

In the fixing liquid of the present invention, other than the organic acid, a coagulant as a constituent to thicken or coagulate an ink composite may be added.

The coagulant applicable to the fixing liquid of the present invention includes salts between following metal ion and acid: an alkali metal ion such as a lithium ion, a sodium ion, and a potassium ion; and a polyvalent metal ion such as an aluminum ion, a barium ion, a calcium ion, a cupper ion, an iron ion, and a magnesium ion; and an organic carbonic acid such as a fumaric acid, a citric acid, a salicylic acid, and a benzoic acid, and an organic sulfonic acid.

Some of the organic acids used for the fixing liquid of the present invention possibly have insufficient solubility to water, and then, an alkaline agent, which dissolves the organic acid can be used together with the above organic acid. Therefore, the fixing liquid of the present invention may contain an organic amine compound or an organic compound having a ring structure. For example, in case of using the organic amine compound, its content is preferably in the range of "organic acid: organic amine compound=1:0.1 to 1:0.9" in molar ratio.

The organic amine compound applicable to the present invention may be any of primary, secondary, tertiary, and quaternary amines, and salts thereof. Preferred examples include triethanolamine, triisopropanolamine, 2-amino-2-ethyl-1,3-propanediol, ethanolamine, propanediamine, and propylamine. The organic amine compound preferably has the weight average molecular weight of 1,000 or less.

<<Recording Medium>>

A recording medium related to the present invention will now be described.

In the inkjet recording apparatus and the inkjet recording method according to the present invention, various recording medium described below is employable.

(Non-Absorbable Recording Medium)

As a recording material utilizable in an image forming method of this invention, various types of non-absorptive plastic and film thereof, which are utilized for so-called soft packaging, in addition to ordinary non-coated paper and coated paper, can be utilized; and as various types of plastic film for, example, polyethylene terephthalate (PET) film, oriented polystyrene (OPS) film, oriented polypropylene (OPP) film, oriented nylon (ONy) film, poly vinyl chloride (PVC) film, polyethylene (PE) film and triacetyl cellulose (TAC) film is listed. As other plastic film, polycarbonate, acrylic resin, polyacetal, PVA and rubbers can be utilized. Further, metals and glasses are applicable. Among these recording materials, the constitution of this invention is effective when images are formed on PET film, OPS film, OPP film, ONy film and PVC film, which are capable of shrinkage by heat.

(Low-Absorbable Recording Medium)

According to the present invention, excellent performances by the ink is exhibited by utilizing a support which has low ink absorption such as art paper, coated paper, cast coated paper and glossy paper.

Paper includes coated paper and non-coated paper. Coated paper includes art paper in which the coated amount on one side is approximately 20 g/m$^2$, coated paper in which the coated amount on one side is approximately 10 g/m$^2$, light weight coated paper in which the coated amount on one side is approximately 5 g/m$^2$, ultra-light weight coated paper, matte finished coated paper, dull-coated paper of dull finished, and newsprint paper.

Non-coated paper includes printing paper A employing 100% chemical pulp, printing paper B employing at least 70% chemical pulp, printing paper C employing from 40-70% chemical pulp, printing paper D employing at most 40% chemical pulp, and gravure paper which incorporates mechanical pulp and has been subjected to calendering. More details on paper are described in "Saishin Kamikako Binran (Handbook of Recent Paper Treatments)", edited by Kako Binran Henshuiinkai, published by Tech. Times and "Insatsu Kogaku Binran (Printing Engineering Handbook)", edited by Nihon Insatsu Gakkai (The Japanese Society of Printing Science and Technology).

As plain paper are used 80 to 200 μm thick non-coated types of paper which are considered as non-coated paper, special printing paper, and information paper. Examples of plain paper usable in the invention include high quality printing paper, medium quality printing paper, and low quality printing paper, thin printing paper, ultra-light weight coated printing paper, or special printing paper such as high quality colored paper, form paper sheets, PPC sheets, and other kinds such as information sheets. Specifically, there is available is paper described below and various modified/treated papers, but the present invention is not limited thereto.

There are cited OK HIGH QUALITY PAPER, OK PRINCE HIGH QUALITY PAPER, OK ISHIKARI, OK EVER LIGHT, OK SOUR CREAM, OK CHOU CREAM, OK SOFT CREAM VANILLA, OK MOON LIGHT CREAM, OK CLEAR WHITE, OK TOP COAT+, OK TOP COAT S, OK TOP COAT MAT N, OKH, OKH-D, OK MAP PAPER, and OK FORM GREEN (nil available from OJI PAPER); SUPER MAT A, HISHI ART BOTH SIDE N, HISHI ART SINGLE SIDE N, PEARL COAT N, NEW V MAT, PEARL SOFT (all available from Mitsubishi Paper Mills, Ltd.); SHIRAOI, RECYCLE HIGH QUALITY, OPERA CREAM ROUGH, OPERA CREAM SK, WHITE LAND, PYRENEES, HIGH LAND, GREEN LAND, ALPS, HAYABUSA, DYNA PURE WHITE, NEPTUNE, JACK, PEGASUS, ESPRI COAT C (all available from Nippon Paper Co., Ltd.); MU MAT, α MAT, HUMING, L BOOK, KINMARI SW, KINMARI V, CREAM KINMARI, MARI COPY, SEMI HIGH QUALITY, S SHIROMARI (all available from Hokuetsu Paper Mills, Ltd.); LIGHT CREAM SENDAI, RAICHOU HIGH QUALITY, RAICHOU SUPER ART N, RAICHOU DULL ART N, RAICHOU COAT N, RAICHOU MAT COAT N, REGINA (all available from Chuetsu Pulp & Paper Co., Ltd.); NIP/KPF, BOD PAPER, FINE PPC, FINE FC, COLOR INKJET PAPER (all produced by Kishu Paper Co., Ltd.); AUDREY, UTRILLO PLUS, GOETHE COAT, KANT EXCEL, DESCARTES EXCEL, DANTE EXCEL, PLATON BULKY CREAM, DANTE, TAIOUBAL (all available from Daio Paper Corporation); NEW BRIGHT, PLAIN PPC PAPER, MULTI PRINTER PAPER (all available from Nagoya Pulp Co., Ltd.); DREAM COAT, CHERRY WHITE DULL, CHERRY WHITE, CHERRY 1 SUPER, STAR LINDEN AW, STAR ELM, STAR LAUREL, BLUE GUM, and YASHIMA 1 (all produced by Marusumi Paper Co., Ltd.).

A sizing agent internally added to the plain paper of this invention includes, for example, a rosin size, AKD, alkenyl succinic anhydride, a petroleum resin size, epichlorohydrin, cationic starch, and acrylamide.

Fillers which are internally added to the plain paper of the invention include, for example, minute particle silicic acid powder, aluminum silicate, diatomaceous earth, kaolin, kaolinite, halloysite, nacrite, dickite, pyrophylite, sericite, titanium dioxide, and bentonite.

To minimize the rear surface penetration of the ink of the invention and enhance fixability of a pigment, the plain paper of the invention may incorporate water-soluble multivalent metal salts.

The water-soluble multivalent metal salts are not particularly limited, and salts such as below, for example, are added: salts of metals such as aluminum, calcium, magnesium, zinc, iron, strontium, barium, nickel, copper, scandium, gallium, indium, titanium, zirconium, tin, or lead, as well as salts such as sulfates, nitrates, formates, succinates, malonates, chloroacetates, or p-toluenesulfonates. There may be used water-soluble inorganic polymers, such as poly(aluminum chloride) as water-soluble salts of multivalent metal ions. In terms of solubility in water, those which exhibit at least 0.1% by mass of solubility in water are preferable, and are more preferable of solubility in water which exhibit at least 1% by mass. Of these, a water-soluble salt composed of aluminum, calcium, aluminum, magnesium, or zinc are preferable, since such metal ions are colorless in the aqueous solution. Particularly preferable are aluminum chloride, aluminum sulfate, aluminum nitrate, aluminum acetate, calcium chloride, calcium sulfate, calcium nitrate, calcium acetate, magnesium sulfate, magnesium nitrate, magnesium acetate, zinc chloride, zinc sulfate, zinc nitrate, and zinc acetate.

(Absorbable Recording Medium)

As for a recording medium utilized by printing via various inks above, a recording medium having ink absorption layer on a substrate can be listed.

In general, the ink absorbing layer is classified mainly into a swelling type and a porous type. A porous type inkjet recording medium is preferable in this invention.

The porous type inkjet recording medium is formed by flocculation of polyvinyl alcohol and inorganic fine particles. Examples thereof include a method in which a coating solution containing at least two kinds of polymers is coated on a support and the polymers are allowed to phase-separate from each other in the drying stage to form pores; a method in which a coating solution containing solid particles and a hydrophilic or hydrophobic resin is coated on a support, dried and then immersed in water or a solution containing an appropriate organic solvent to allow the solid particles to be solubilized to form pores; a method in which a coating solution containing a compound capable of foaming to form a film and this compound is allowed to foam in the drying stage to form pores in the interior of the film; a method in which a coating solution containing porous solid particles and a hydrophilic binder is coated on a support to form pores in the interior of the particle or between particles; and a method in which a coating solution containing a hydrophilic binder, and solid particles and/or fine oil droplets at a volume amount equivalent to or more than the volume of the binder, is coated on a support to form pores between solid particles. In this invention, the porous layer is formed preferably by allowing various kinds of inorganic particles of an average particle size of 100 nm or less.

Inorganic fine particles utilizable in this invention include, for example, white inorganic pigments such as light calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, silica, alumina, colloidal alumina, pseudoboehmite, aluminum hydroxide, litopon, zeolite and magnesium hydroxide.

As inorganic fine particles, preferred is to use solid fine particles selected from silica, alumina or aluminum hydrate.

As silica according to the present invention, silica synthesized by general wet process, colloidal silica or silica synthesized by gas phase process is preferably employed. Especially preferred is colloidal silica or silica synthesized by gas phase process. Among them, silica synthesized by gas phase process is preferred because that it tends not to form coarse aggregate even when it is added tin cationic polymer which is used for fixing dye as well as high porosity can be obtained. Further, as alumina or alumina hydrate, either crystalline or amorphous can be employed and also any shape of particles such as infinite, sphere or needle can be employed.

The average particle size of inorganic fine particles described above is preferably not more than 100 nm. For example, in the case of silica synthesized by gas phase process, an average particle size of inorganic particles dispersed in a state of a primary particle is specifically preferably not more than 100 nm, more preferably 4-50 nm, most preferably 4-20 nm.

Polyvinyl alcohols preferably utilized in this invention include modified polyvinyl alcohols such as those provided with a cationic modified end group or anionic modified polyvinyl alcohol provided with an anionic group, in addition to ordinary polyvinyl alcohol prepared by hydrolysis of polyvinyl acetate.

Polyvinyl alcohol prepared by hydrolysis of polyvinyl acetate is provided with a polymerization degree of preferably not less than 1,000 and specifically preferably 1,500-5,000.

Cationic modified polyvinyl alcohol includes, for example, polyvinyl alcohol provided with a primary to tertiary amino group or a quaternary ammonium group in a main or side chain of the above described polyvinyl alcohol, and these are prepared by hydrolysis of a copolymer of an ethylenic unsaturated monomer having a cationic group and vinyl acetate.

Ethylenic unsaturated monomers having a cationic group include, for example, trimethyl-(2-acrylamido-2,2-dimethylethyl)ammonium chloride, trimethyl-(3-acrylamido-3,3-dimethylpropyl)ammonium chloride, N-vinylimidazole, N-methylvinylimidazole, N-(3-dimethylaminopropyl)methacrylamide, hydroxyethyl trimethylammonium chloride, trimethyl-(2-methacrylamidopropyl)ammonium chloride. and N-(1,1-diimethyl-3-dimethylaminopropyl) acrylamide.

The content of a monomer containing a cationic modified group in cationic modified polyvinyl alcohol is 0.1-10 mol % and preferably 0.2-5 mol % based on vinyl acetate.

The content of the above described inorganic fine particles in an ink absorptive layer largely depends on required absorbing ink volume, porosity ratio of porous layer, species of inorganic particles, species of polyvinyl alcohol, and generally is 5 to 30 g, preferably 10 to 25 g per 1 $m^2$ of recording medium.

The ratio of inorganic fine particles against a polyvinyl alcohol in an ink absorptive layer is generally from 2:1 to 20:1, preferably from 3:1 to 10:1.

Further, cationic water-soluble polymer having tertial ammonium group in a molecule may be included, and the using amount is generally 0.1 to 10 g, preferably 0.2 to 5.0 g, per 1 $m^2$ of a recording medium.

Hardeners can be utilizable in this invention in terms of enhancing ink absorption. They are not specifically limited provided they cause a curing reaction with a water soluble binder, however, preferably boric acid and salts thereof. In addition, those commonly known can be utilized other than these, and they are generally compounds provided with a group reactive with a polyvinyl alcohol or compounds to accelerate a reaction between different groups of a polyvinyl alcohol each other, which are utilized by suitable selection corresponding to a type of a polyvinyl alcohol. Specific examples of the hardener include, for example, epoxy type hardeners (such as diglycidyl ethylether, ethyleneglycol diglycidylether, 1,4-butanediol diglycidylether, 1,6-diglycidylcyclohexane, N,N-diglycidyl-4-glycidyloxyaniline, sorbitol polyglycidylether and glycelol polyglycidylether), aldehyde type hardeners (such as formaldehyde and glyoxal), active halogen type hardeners (such as 2,4-dichloro-4-hydroxy-1,3,5-s-triazine), active vinyl type hardeners (such as 1,3,5-trisacryloyl-hexahydro-s-triazine and bisvinylsulfonyl methylether) and aluminum alum.

As a substrate usable to inkjet recording medium above, for example, plastic substrate, paper substrate both side covered with polyolefin, and complex substrate laminated thereof can be employed by selecting appropriately. As for the substrate utilized in the void-type ink absorptive layer above, preferred is a non-absorbable substrate.

Plastic substrate employable in the present invention may be transparent or opaque and various resin film can be employable. Polyolefin film such as polyethylene, and polypropylene; polyester film such as polyethylene terephthalate and polyethylene naphthalate; polyvinylchloride, and cellulose tri-acetate can be usable, and polyester film is preferred. As polyester film (hereinafter, refer to as polyester), preferred is a polyester having dicarboxylic acid component and diol component as main constituent of compound and having film forming property, however is not limited thereto. Dicarboxylic acid component as main constituent of compound include: terephthalic acid, isophthalic acid, phthalic acid, 2,6-naphthalene dicarboxylic acid, 2,7-naphthalene dicarboxylic acid, diphenylsulfon dicarboxylic acid, diphenylether dicarboxylic acid, diphenylethane dicarboxylic acid, cyclohexane dicarboxylic acid, diphenyl dicarboxylic acid, diphenylthioether dicarboxylic acid, diphenylketone dicarboxylic acid and diphenylindane dicarboxylic acid. Diol component include: ethylene glycol, propylene glycol, tetramethylene glycol, cyclohexane dimethanol, 2,2-bis(4-hydroxyphenyl) propane, 2,2-bis(4-hydroxethoxyyphenyl) propane, bis(4-hydroxyphenyl) sulfone, bisphenolfluorene dihydroxy ethylether, diethylene glycol, neopentyl glycol, hydroquinone and cyclohexandiol.

EXAMPLES

Hereinbelow, the present invention will be specifically described with reference to embodiments thereof; but the present invention is not limited to them. In the examples, the terms "part" and "%" will be used, and they indicate "part by mass" and "% by mass" respectively, unless otherwise stated.

[Production of Ink Set of Water-Based UV Ink (Water-Based Active Actinic Energy Radiation Curable Ink)]

[Ink Formulation]

<Synthesis of High-Molecular Compound A>

Into a reaction vessel were introduced 56 g of glycidyl methacrylate, 48 g of p-hydroxybenzaldehyde, 2 g of pyridine, and 1 g of N-nitroso-phenyl hydroxy ammonium salt, which were then stirred for 10 hours in a hot water bath at 85° C. Subsequently, after 45 g of polyvinyl acetate saponified compound having a degree of polymerization of 300 and a degree of saponification of 98% was dispersed into 225 g of ion-exchanged water, 4.5 g of phosphoric acid and p-(3-methacryloxy-2-hydroxypropoxy)benzaldehyde, which was prepared by the above reaction, were added so that the percent of modification became 3 mol % to the polyvinyl acetate saponified compound, and then, the mixture was stirred at 90° C. for 8 hours. The solution thus obtained was cooled down to a room temperature, after which 30 g of a basic ion exchange resin was added and the solution was stirred for one hour. Subsequently, the ion exchange resins were filtered out, and then, into the filtered solution, IRGACURE 2959 (manufactured by Ciba-Geigy Corp.) as a polymerization initiator was mixed at a rate of 0.25 g of IRGACURE to 100 g of the above solution. After that, the resultant solution was diluted with an ion exchange resin to prepare the high-molecular compound A having a dilution of 15%.

(Preparation of Pigment Dispersion)

<Preparation of Magenta Pigment Dispersion>

Each of additives below was mixed, and then dispersed using a sand grinder filled with zirconia beads of 0.6 mm in 50% by a volume fraction, to prepare a magenta pigment dispersion having a magenta pigment content of 15%. The average particle size of the magenta pigment particle contained in the magenta pigment dispersion was 120 nm. The particle size was determined via ZETASIZER 1000 HS, manufactured by Malvern Co.

| | |
|---|---|
| C.I. Pigment Red 122 | 15 parts |
| JONCRYL 61 (a dispersing agent of styrene-acryl type resin, manufactured by Johnson Co., a solid content of 30%) | 10 parts |
| Glycerin | 15 parts |
| Ion-exchanged water | 67 parts |

<Preparation of Black Pigment Dispersion>

Carbon black self-dispersion CABOJET 300, produced by Cabot Co., was diluted with ion-exchanged water to prepare a black pigment dispersion having a carbon black content of 15%. The average particle size of the carbon black particle contained in the black pigment dispersion was 130 nm. The particle size was determined via ZETASIZER 1000 HS, manufactured by Malvern Co.

<Preparation of Yellow Pigment Dispersion>

Each of additives below was mixed, and then dispersed using a sand grinder filled with zirconia beads of 0.6 mm in 50% by a volume fraction, to prepare a yellow pigment dispersion having a yellow pigment content of 15%. The average particle size of the yellow pigment particle contained in the yellow pigment dispersion was 110 nm. The particle size was determined via ZETASIZER 1000 HS, manufactured by Malvern Co.

| | |
|---|---|
| C.I. Pigment Yellow 74 | 15 parts |
| JONCRYL 61 (a dispersing agent of styrene-acryl type resin, manufactured by Johnson Co., a solid content of 30%) | 10 parts |
| Glycerin | 15 parts |
| Ion-exchanged water | 67 parts |

<Preparation of Cyan Pigment Dispersion>

Each of additives below was mixed, and then dispersed using a sand grinder filled with zirconia beads of 0.6 mm in 50% by a volume fraction, to prepare a cyan pigment dispersion having a cyan pigment content of 15%. The average particle size of the cyan pigment particle contained in the cyan pigment dispersion was 130 nm. The particle size was determined via ZETASIZER 1000 HS, manufactured by Malvern Co.

| | |
|---|---|
| C.I. Pigment Blue 15 | 15 parts |
| JONCRYL 61 (a dispersing agent of styrene-acryl type resin, manufactured by Johnson Co., a solid content of 30%) | 10 parts |
| Glycerin | 15 parts |
| Ion-exchanged water | 67 parts |

<Preparation of Ink Set>

<Preparation of Magenta Ink>

| | |
|---|---|
| High-molecular compound A | 20 parts |
| Magenta pigment dispersion | 20 parts |
| Phosphate buffer solution | 10 parts |
| OLFIN E1010 (produced by Nissin Chemical Industry Co., Ltd.: a surfactant) | 0.1 parts |
| Ethylene glycol | 20 parts |

Each of materials described above were mixed, after which ion-exchanged water was added to make a total of 100 parts to prepare a magenta ink.

<Preparation of Yellow Ink>

A yellow ink was prepared in a similar manner to the above preparation of the magenta ink except that the yellow pigment dispersion was used in place of the magenta pigment dispersion.

<Preparation of Black Ink>

A black ink was prepared in a similar manner to the above preparation of the magenta ink except that the black pigment dispersion was used in place of the magenta pigment dispersion.

<Preparation of Cyan Ink>

A cyan ink was prepared in a similar manner to the above preparation of the magenta ink except that the cyan pigment dispersion was used in place of the magenta pigment dispersion.

[Preparation of Ink Set of Water-Based Fixing Ink]

<<Preparation of Ink>>

(Synthesis of Dispersing Resin)

Into a flask equipped with a dropping funnel, a nitrogen gas introduction tube, a reflux cooling tube, a thermometer, and a stirrer, added was 50 g of methylethylketone, and the mixture was heated to 75° C. while the nitrogen bubbling was continued. Into the flask, dropped from a dropping funnel over three hours was a mixture of monomers of 75 g of n-butyl methacrylate, 5 g of butyl acrylate, 5 g of 2-hydroxyethyl methacrylate, and 15 g of acrylic acid; and 50 g of methylethylketone, and 500 mg of polymerization initiator (AIBN). After the dropping, the solution was heated to reflux over another six hours. After cooling, methylethylketone of an amount equivalent to the amount volatilized was added, to prepare a resin solution of the dispersing resin D-1 (a solid content of 50% by mass).

(Preparation of Pigment Dispersion Element)

To 100 g of solution of the synthesized dispersing resin D-1 (a solid content of 50% by mass), added was a prescribed amount of aqueous sodium hydroxide of 20% by mass as a neutralizer to neutralize 100 percent of salt-producing group. After that, 50 g of pigment (C: C.I. Pigment Blue 15:3, Y: C.I. Pigment Yellow 74, M: C.I. Pigment Red 122 or Bk: carbon black) was added little by little while stirring, after which the resultant mixture was kneaded for two hours using a bead mill. To the kneaded compound thus obtained, added was 400 g of ion-exchanged water, and after stirring it, the solution was heated under reduced pressure to distil away the methylethylketone. Ion-exchanged water was further added to the solution to obtain each of pigment dispersion elements P-1 to P-4 from each of pigments C, Y, M, and Bk.

(Synthesis of Ink Soluble Resin)

Into a flask equipped with a dropping funnel, a nitrogen gas introduction tube, a reflux cooling tube, a thermometer, and a stirrer, added was 50 g of methylethylketone, and the mixture was heated to 75° C. while the nitrogen bubbling was continued. Into the flask, dropped from a dropping funnel over three hours was a mixture of 80 g of n-butyl methacrylate, 20 g of acrylic acid, and 50 g of methylethylketone, and 500 mg of polymerization initiator (AIBN). After the dropping, the solution was heated to reflux over another six hours. After cooling, the solution was heated under reduced pressure to distil away the methylethylketone. Dimethylaminoethanol of an amount equivalent to 1.05 times in mole of the acrylic acid which was added as a monomer was dissolved to 450 ml of ion-exchanged water, and then, the above polymer residue was dissolved into the above resultant solution. The concentration of the solution was regulated with ion-exchanged water to obtain ink soluble resin solution of ink soluble resin R-1 (a solid content of 20% by mass).

(Preparation of Ink)

<Preparation of Cyan Ink>

The pigment dispersion element, the ink soluble resin, a water-soluble organic solvent and a surfactant were mixed with a condition described below, and then, ion-exchanged water was added to the above mixture and regulated so that the total amount became 100 g. After that, the solution was filtered through a filter of 5 μm to obtain a cyan ink.

| | |
|---|---|
| Pigment dispersion element: P-1 | 5.0 parts by mass |
| Ink soluble resin: R-1 | 5.0 parts by mass |
| Water-soluble organic solvents | |
| 1,2-hexandiol | 5.0 parts by mass |
| γ-butyrolactone | 5.0 parts by mass |
| diethylene glycol | 10.0 parts by mass |

-continued

| | |
|---|---|
| Surfactant: KF-351A (produced by Shin-Etsu Chemical Co., Ltd.) | 0.6 parts by mass |

<Preparation of Yellow Ink>

A yellow ink was prepared in a similar manner to the above preparation of the cyan ink except that the pigment dispersion element: P-2 was used in place of the pigment dispersion element: P-1.

<Preparation of Black Ink>

A black ink was prepared in a similar manner to the above preparation of the cyan ink except that the pigment dispersion element: P-4 was used in place of the pigment dispersion element: P-1.

<Preparation of Magenta Ink>

A magenta ink was prepared in a similar manner to the above preparation of the cyan ink except that the pigment dispersion element: P-3 was used in place of the pigment dispersion element: P-1.

[Preparation of Ink Set of Water-Based Pigment Ink]

(Preparation of Pigment Dispersion)

<Preparation of Yellow Pigment Dispersion Element>

| | |
|---|---|
| C.I. Pigment Yellow 74 | 20% by mass |
| Styrene-acrylic acid copolymer (molecular weight: 10,000, and acid value: 120) | 12% by mass |
| Diethylene glycol | 15% by mass |
| Ion-exchanged water | 53% by mass |

Each of the above additives was mixed, and then dispersed using a horizontal bead mill (SYSTEM ZETA MINI, manufactured by Ashizawa Ltd.) filled with zirconia beads of 0.3 mm in 60% by a volume fraction, to prepare a yellow pigment dispersion element. The average particle size of the yellow pigment thus obtained was 112 nm.

<Preparation of Magenta Pigment Dispersion Element>

| | |
|---|---|
| C.I. Pigment Red 122 | 25% by mass |
| JONCRYL 61 (an acryl-styrene type resin, manufactured by Johnson Co.) | 18% by mass in solid content |
| Diethylene glycol | 15% by mass |
| Ion-exchanged water | 42% by mass |

Each of the above additives was mixed, and then dispersed using a horizontal bead mill (SYSTEM ZETA MINI, manufactured by Ashizawa Ltd.) filled with zirconia beads of 0.3 mm in 60% by a volume fraction, to prepare a magenta pigment dispersion element. The average particle size of the magenta pigment thus obtained was 105 nm.

<Preparation of Cyan Pigment Dispersion Element>

| | |
|---|---|
| C.I. Pigment Blue 15:3 | 25% by mass |
| JONCRYL 61 (an acryl-styrene type resin, manufactured by Johnson Co.) | 15% by mass in solid content |
| Glycerin | 10% by mass |
| Ion-exchanged water | 50% by mass |

Each of the above additives was mixed, and then dispersed using a horizontal bead mill (SYSTEM ZETA MINI, manufactured by Ashizawa Ltd.) filled with zirconia beads of 0.3 mm in 60% by a volume fraction, to prepare a cyan pigment dispersion element. The average particle size of the cyan pigment thus obtained was 87 nm.

<Preparation of Black Pigment Dispersion Element>

| | |
|---|---|
| Carbon black | 20% by mass |
| Styrene-acrylic acid copolymer (molecular weight: 7,000, and acid value: 150) | 10% by mass |
| Glycerin | 10% by mass |
| Ion-exchanged water | 60% by mass |

Each of the above additives was mixed, and then dispersed using a horizontal bead mill (SYSTEM ZETA MINI, manufactured by Ashizawa Ltd.) filled with zirconia beads of 0.3 mm in 60% by a volume fraction, to prepare a black pigment dispersion element. The average particle size of the black pigment thus obtained was 75 nm.

(Preparation of Pigment Ink)

<Preparation of Yellow Ink>

| | |
|---|---|
| Yellow pigment dispersion element | 15% by mass |
| Ethylene glycol | 20% by mass |
| Diethylene glycol | 10% by mass |
| Surfactant (SURFYNOL 465, produced by Nissin Chemical Industry Co., Ltd) | 0.1% by mass |
| Ion-exchanged water | 54.9% by mass |

Each of the above compounds was mixed, which mixture was then stirred. The resultant solution was filtered through a filter of 1 μm, to prepare a yellow ink, which was the water-based pigment ink of the present invention. The average particle size of the pigment in the aforesaid ink was 120 nm, and the surface tension γ of the ink was 36 mN/m.

<Preparation of Magenta Ink>

| | |
|---|---|
| Magenta pigment dispersion element | 15% by mass |
| Ethylene glycol | 20% by mass |
| Diethylene glycol | 10% by mass |
| Surfactant (SURFYNOL 465, produced by Nissin Chemical Industry Co., Ltd) | 0.1% by mass |
| Ion exchanged water | 54.9% by mass |

Each of the above compounds was mixed, which mixture was then stirred. The resultant solution was filtered through a filter of 1 μm, to prepare a magenta ink, which was the water-based pigment ink of the present invention. The average particle size of the pigment in the aforesaid ink was 113 nm, and the surface tension γ of the ink was 35 mN/m.

<Preparation of Cyan Ink>

| | |
|---|---|
| Cyan pigment dispersion element | 10% by mass |
| Ethylene glycol | 20% by mass |
| Diethylene glycol | 10% by mass |
| Surfactant (SURFYNOL 465, produced by Nissin Chemical Industry Co., Ltd) | 0.1% by mass |
| Ion exchanged water | 59.9% by mass |

Each of the above compounds was mixed, which mixture was then stirred. The resultant solution was filtered through a filter of 1 μm, to prepare a cyan ink, which was the water-based pigment ink of the present invention. The average particle size of the pigment in the aforesaid ink was 95 nm, and the surface tension γ of the ink was 36 mN/m.

<Preparation of Black Ink>

| | |
|---|---|
| Black pigment dispersion element | 10% by mass |
| Ethylene glycol | 20% by mass |
| Diethylene glycol | 10% by mass |
| Surfactant (SURFYNOL 465, produced by Nissin Chemical Industry Co., Ltd) | 0.1% by mass |
| Ion exchanged water | 59.9% by mass |

Each of the above compounds was mixed, which mixture was then stirred. The resultant solution was filtered through a filter of 1 μm, to prepare a black ink, which was the water-based pigment ink of the present invention. The average particle size of the pigment in the aforesaid ink was 85 nm, and the surface tension γ of the ink was 35 mN/m.

[Preparation of Fixing Liquid]

<Coagulation Liquid>

A fixing liquid 1 containing polyallylamine as coagulation liquid was prepared.

[Preparation of Fixing Liquid 1]

The fixing liquid 1 was prepared by adding ion-exchanged water to the mixture of following compounds to make 100%:

| | |
|---|---|
| Polyallylamine PAA-10C (resin component: 10%, produced by Nitto Boseki Co., Ltd.) | 30% |
| Triethylene glycol monobutyl ether | 10% |
| Glycerin | 8% |

<Insolubilization Solution>

A fixing liquid 2 containing an organic acid as insolubilization solution was prepared.

[Preparation of Fixing Liquid 2]

The fixing liquid 2 was prepared by adding ion-exchanged water to the mixture of following compounds to make 100%:

| | |
|---|---|
| Diethylene glycol | 28.0% |
| 2-furan carboxylic acid | 7.0% |
| Triethanolamine | 3.0% |
| Acetylene glycol ethylene oxide adduct | 1.0% |

<<Image Recording>>

Example 1

[Sample No. 1]

Using an inkjet recording apparatus of FIG. 4, in which a line head unit having a nozzle arrangement of FIG. 2*a* was arranged, monochrome image recording was carried out using a yellow ink on a recording medium of PET (polyethylene terephthalate) film with a yellow ink of an ink set of water-based UV ink and coagulation liquid as a fixing liquid having been charged into the line head HY1 and the line head HT1 respectively.

As the ultraviolet ray irradiating device 5, a line head type ultraviolet irradiation measures was constituted by setting metal halide lamps of 160 W/cm$^2$ (MAN 200 (N)L, produced by Nippon Denchi Co., Ltd.)

The image was a 100 percent yellow solid image, and a yellow ink dot and a fixing liquid dot were formed, in a sequence of deposit of droplets as described above, on each image element, and after that, ultraviolet rays were irradiated thereon.

[Sample No. 2]

Image recording was carried out in a similar manner to the sample No. 1 except that dots were formed in a sequence of deposit of droplets as described above using an inkjet recording apparatus of FIG. 4, in which a line head unit having a nozzle arrangement of FIG. 2*b* was arranged, with a yellow ink of an ink set of water-based UV ink and coagulation liquid as a fixing liquid having been charged into the line heads HY1 and HY2 and the line heads HT1 and HT2 respectively.

[Sample No. 3]

Image recording was carried out in a similar manner to the sample No. 1 except that an art paper was used as the recording medium.

[Sample No. 4]

Image recording was carried out in a similar manner to the sample No. 2 except that an art paper was used as the recording medium.

[Sample No. 5]

Image recording was carried out in a similar manner to the sample No. 2 except that using a yellow ink of an ink set of a water-based fixing ink as an ink, and an inkjet recording apparatus of FIG. 1 having no ultraviolet irradiation device 5, the recording medium was heated using a heater so that surface temperature of the recording side of the recording medium became 50° C.

[Sample No. 6]

Image recording was carried out in a similar manner to the sample No. 5 except that an art paper was used as the recording medium.

[Sample No. 7]

Image recording was carried out in a similar manner to the sample No. 6 except that a yellow ink of an ink set of a water-based pigment ink was used as the ink.

[Sample No. 8]

Image recording was carried out in a similar manner to the sample No. 6 except that an insolubilization solution was used as the fixing liquid.

[Sample No. 9]

Image recording was carried out in a similar manner to the sample No. 4 except that an insolubilization solution was used as the fixing liquid.

[Sample No. 10]

Image recording was carried out in a similar manner to the sample No. 7 except that an insolubilization solution was used as the fixing liquid.

<<Evaluation of Recorded Image>>

On each of images produced by the above sample Nos. 1 to 10, the beading was evaluated based on a method described below.

[Evaluation of Beading]

After yellow solid images, formed on the recording medium according to each of the above sample Nos. 1 to 10, were outputted, existence or nonexistence of the beading of the recorded solid images were visually observed, and then, the beading was evaluated in accordance with the following criteria.

Good: No beading is observed.

Poor: Pretty bad beading is observed all over the sample, and the sample is impractical.

Each of the results obtained based on the above evaluation is given in Table 1.

TABLE 1

| Sample No. | Recording Medium | Fixing Liquid | Ink containing Color Material | Beading | Note |
|---|---|---|---|---|---|
| 1 | PET | Coagulation Liquid | Water-based UV Ink | Poor | Comparative Example |
| 2 | PET | Coagulation Liquid | Water-based UV Ink | Good | Inventive Example |
| 3 | Art Paper | Coagulation Liquid | Water-based UV Ink | Poor | Comparative Example |
| 4 | Art Paper | Coagulation Liquid | Water-based UV Ink | Good | Inventive Example |
| 5 | PET | Coagulation Liquid | Water-based Fixing Ink | Good | Inventive Example |
| 6 | Art Paper | Coagulation Liquid | Water-based Fixing Ink | Good | Inventive Example |
| 7 | Art Paper | Coagulation Liquid | Water-based Pigment Ink | Good | Inventive Example |
| 8 | Art paper | Insolubilization Solution | Water-based Fixing Ink | Good | Inventive Example |
| 9 | Art Paper | Insolubilization Solution | Water-based UV Ink | Good | Inventive Example |
| 10 | Art Paper | Insolubilization Solution | Water-based Pigment Ink | Good | Inventive Example |

As can be clearly seen from the results described in Table 1, it is found that the image recorded by using the inkjet recording apparatus composed of the constitution stipulated in the present invention is excellent in the beading, compared to the comparative example.

Example 2

For sample Nos. 1 to 10 of Example 1, a colored solid image recording was carried out using ink sets of yellow, magenta, cyan and black, and then, beading and color bleed were evaluated.

[Evaluation of Beading]

The beading of the solid image, in which four colors of yellow, magenta, cyan and black were superimposed, was evaluated in the similar manner to Example 1.

[Evaluation of Color Bleed]

On a red solid image of 10 cm×10 cm prepared by using magenta and yellow inks, an image pattern, in which black letters were arranged by using a black ink, was output with various printing points.

Existence or nonexistence of color mixture of the recorded letter image was visually observed, and color bleeding resistance was evaluated in accordance with the following criteria.

Good: No generation of color mixture

Poor: Color mixture is so bad that it is impossible to read letters of 12 point.

The image recorded by using the inkjet recording apparatus composed of the constitution stipulated in the present invention was evaluated to be good in both beading and color bleed, and therefore, it was confirmed that the above image was excellent in both beading and color bleed, compared to comparative examples which were evaluated to be poor in both beading and color bleed.

What is claimed is:

1. An inkjet recording apparatus comprising an ink line head equipped with nozzle rows having a plurality of nozzles arranged at a predetermined pitch for discharging an ink containing a coloring material, and a fixing liquid line head equipped with nozzle rows having a plurality of nozzles arranged at a predetermined pitch for discharging a fixing liquid which enhances the fixture of the ink to a recording medium, and which performs a record by discharging the ink and the fixing liquid from each line head to the recording medium while moving the recording medium and each line head relatively in a predetermined direction, wherein each of the nozzle rows of the ink line head and the nozzle rows of the fixing liquid line head are arranged adjoiningly for each color so that they are deviated from each other by one half of the predetermined pitch in a nozzle row direction, wherein the inkjet recording apparatus further comprises two sets of the combination of the ink line head and the fixing liquid line head, and the two ink line heads discharge ink containing the same color material, wherein the nozzle rows of one ink line head and the nozzle rows of one fixing liquid line head in one line head set each are arranged so that they deviate from another ink line head and nozzle rows of another fixing liquid line head in another line head set by one half of the predetermined pitch in the nozzle row direction.

2. The inkjet recording apparatus of claim 1, wherein the fixing liquid contains an organic acid.

3. The inkjet recording apparatus of claim 1, wherein the fixing liquid contains a polyallylamine.

4. The inkjet recording apparatus of claim 1, wherein the ink is an actinic energy radiation curable ink.

5. The inkjet recording apparatus of claim 4, wherein the actinic energy radiation curable ink is a water-based ultraviolet ray curable ink.

6. The inkjet recording apparatus of claim 1, wherein the ink is a water-based pigment ink.

7. The inkjet recording apparatus of claim 6, wherein the water-based pigment ink is a fixing type of water-based pigment ink.

8. The inkjet recording apparatus of claim 1, wherein the recording medium is a non-absorbable recording medium.

9. The inkjet recording apparatus of claim 1, wherein the recording medium is an art paper or a coated paper.

10. The inkjet recording apparatus of claim 1, comprising two sets of the combination of the ink line head and the fixing liquid line head for each of colors of Y, M, C and K.

11. An inkjet recording method performed with an inkjet recording apparatus wherein a recording is performed by discharging an ink containing coloring material from an ink line head equipped with nozzle rows having a plurality of nozzles and by discharging a fixing liquid from a fixing liquid line head equipped with nozzle rows having a plurality of nozzles for discharging fixing liquid which enhances the fixtures of the ink to a recording medium, while moving the recording medium and each line head relatively in a predetermined direction, comprising steps of:

discharging a plurality of recording dots arranged in a nozzle row direction from each nozzle of either the ink line head or the fixing liquid line head, while moving in the predetermined direction, followed by discharging a plurality of recording dots so that the plurality of recording dots can land at least between a plurality of the previously discharged recording dots from each nozzle of the other line head, wherein each of the nozzle rows of the ink line head and the nozzle rows of the fixing liquid line head are arranged adjoiningly for each color so that they deviate from each other by one half of a predetermined pitch in a nozzle row direction, and the inkjet recording apparatus comprising two sets of the combination of the ink line head and the fixing liquid line head, and the two ink line heads discharge the ink containing the same coloring material, wherein the nozzle rows of the one ink line head and the nozzle rows of one fixing liquid line head in one line head set each are arranged so that they deviate from another ink line head and nozzle rows of another fixing liquid line head in another line head set by one half of the predetermined pitch in the nozzle row direction.

* * * * *